US011905718B2

(12) United States Patent
Jasinski

(10) Patent No.: US 11,905,718 B2
(45) Date of Patent: Feb. 20, 2024

(54) SYSTEMS AND METHODS FOR TILE FLOOR CONSTRUCTIONS

(71) Applicant: Chris Jasinski, Woodstock (CA)

(72) Inventor: Chris Jasinski, Woodstock (CA)

(73) Assignee: CB Interests Inc., Woodstock (CA)

( * ) Notice: Subject to any disclaimer, the term of this patent is extended or adjusted under 35 U.S.C. 154(b) by 46 days.

(21) Appl. No.: 17/045,012

(22) PCT Filed: Apr. 3, 2019

(86) PCT No.: PCT/CA2019/050406
§ 371 (c)(1),
(2) Date: Oct. 2, 2020

(87) PCT Pub. No.: WO2019/191839
PCT Pub. Date: Oct. 10, 2019

(65) Prior Publication Data

US 2021/0164239 A1 Jun. 3, 2021

Related U.S. Application Data

(60) Provisional application No. 62/779,816, filed on Dec. 14, 2018, provisional application No. 62/652,391, filed on Apr. 4, 2018.

(51) Int. Cl.
*E04F 15/18* (2006.01)
*E04F 15/02* (2006.01)

(52) U.S. Cl.
CPC ..... *E04F 15/18* (2013.01); *E04F 15/02183* (2013.01)

(58) Field of Classification Search
CPC ..... E04F 15/185; E04F 15/186; E04F 15/182; E04F 15/18; B32B 27/12
See application file for complete search history.

(56) References Cited

U.S. PATENT DOCUMENTS 3,521,418 A * 7/1970 Bartoloni ..... E04F 13/0862 428/49
5,226,273 A 7/1993 Burke
(Continued)

FOREIGN PATENT DOCUMENTS

WO 1986007008 A1 12/1986

OTHER PUBLICATIONS

International Search Report and Written Opinion dated Jun. 25, 2019 in related International Patent Application No. PCT/CA2019/050406 (11 pages).

(Continued)

*Primary Examiner* — Babajide A Demuren
*Assistant Examiner* — Daniel J Kenny
(74) *Attorney, Agent, or Firm* — Bereskin & Parr LLP

(57) ABSTRACT

Flexible support screens and tile spacers for floating tile floor systems are described herein. The flexible support screens include a compressible body that is configured to engage a top surface of a structure. The compressible body has a plurality of channels configured to direct a fluid through the compressible body. The flexible support screen has a variable rate of compression upon receiving a force directed upon either the upper surface or the lower surface. The adhesive tiles spacers have a first side surface for engaging a first tile and a second side surface opposed to the first side surface for engaging a second tile. The adhesive spacers are configured to be compressible to absorb movement of the first tile and the second tile towards or away from each other.

15 Claims, 29 Drawing Sheets

(56) References Cited

U.S. PATENT DOCUMENTS 5,238,721 A * 8/1993 Nakazawa ..... E04F 15/02011 52/390
5,280,692 A 1/1994 Patey
5,479,750 A 1/1996 Carlberg
6,301,842 B1 10/2001 Chaney et al.
7,536,835 B2 * 5/2009 Schluter ..... E04F 15/18 52/302.1
8,266,849 B2 9/2012 Bravo et al.
8,347,575 B2 * 1/2013 Bierwirth ..... E04F 15/203 52/145
8,359,807 B2 * 1/2013 Kang ..... B32B 9/045 52/592.1
8,468,770 B2 * 6/2013 McDonald ..... B32B 27/30 428/95
8,536,077 B2 * 9/2013 LaVietes ..... E04F 15/186 442/76
8,667,744 B2 3/2014 Shaw
8,955,278 B1 * 2/2015 Mills ..... E04F 15/02038 52/302.3
9,151,063 B2 10/2015 McManus
10,941,573 B2 * 3/2021 Zhou ..... D06N 3/0006
2003/0219582 A1 * 11/2003 Ramesh ..... E04F 15/18 428/315.9
2006/0032170 A1 * 2/2006 Vershum ..... E04F 15/186 52/746.1
2011/0203200 A1 * 8/2011 Marquardt ..... E04B 5/12 52/582.1
2012/0017528 A1 * 1/2012 Liu ..... E04F 13/0862 52/309.1
2014/0083034 A1 * 3/2014 Albert ..... E04C 2/20 156/308.2

OTHER PUBLICATIONS

Shock Control 2.0. Datasheet [online]. Kronos Ceramiche, 2018 [retrieved on Oct. 3, 2018]. Retrieved from <www.kronosceramiche.com> (2 pages).

* cited by examiner

SYSTEMS AND METHODS FOR TILE FLOOR CONSTRUCTIONS

CROSS-REFERENCE TO RELATED APPLICATIONS

This application claims priority to U.S. Provisional Patent Application No. 62/652,391, filed Apr. 4, 2018 and U.S. Provisional Patent Application No. 62/779,816, filed Dec. 14, 2018, both of which are incorporated herein by reference in their entirety.

TECHNICAL FIELD

The embodiments disclosed herein relate to tile floor constructions, and more specifically to tile floor constructions for overlaying structures such as but not limited to decks, patios, porches, and interior wooden and concrete floors.

BACKGROUND

Floors are often finished with a top layer of stone or ceramic tile to give a long lasting and aesthetically pleasing floor construction. Traditionally, finishing a floor with a top layer of stone or ceramic tile required the tiles to be physically bonded to a subfloor by a material such as an adhesive, a mortar and/or grout. These types of tile floor installations provide a rigid connection for the tiles but are inflexible, so the tiles are unable to move in response to expansion and contraction of the structural base. As such, expansion or contraction of the structural base results in cracked tiles and/or cracked mortar.

To combat this issue, decoupling membranes have been developed to separate the tile adhesive layer from the structural base. While this approach has been successful for interior applications, it is complicated, expensive, labor intensive, and is not appropriate for exterior applications as the final installation is rigid in nature.

Large format (e.g. 2 cm thick) porcelain tiles that are strong enough to be used in floating applications without a rigid substructure have been developed. These tiles are generally stronger, thinner and weigh less than natural stone tiles and traditional cementitious pavers. These large format porcelain tiles have been successfully employed in exterior applications in all climatic regions for floating patio installations on compacted mineral bases, where polymeric sand is often used to fill gaps between tiles, as well as in raised patio and roof top installations on structural bases with adjustable pedestals and rigid spacers to separate the tiles.

Thick cementitious pavers are not appropriate for installations that are sensitive to thickness, and as such laying thick pavers over an existing deck can result in a significant increase in overall height of the deck that may be unacceptable. Further, existing wooden decks and concrete or steel subfloors are generally not perfectly flat, and to compound installation challenges, wooden floor structures regularly move and twist as humidity changes seasonally.

Accepted interior installation methods cannot easily accommodate these types of climatic changes (especially in freeze prone regions). While rigid pedestals or compacted sand bases do accommodate for floating installations, installing rigid tiles directly onto a wooden, cementitious, or steel subfloor often results in tiles wobbling, chipping and breaking and, in the case of exterior wooden decking, may result in moisture accumulating between the underside of the mineral tiles and the top surface of the deck boards. This can cause rapid deterioration of the wooden subfloor.

For wooden subfloors such as an exterior deck, an alternate approach is to remove the wooden subfloor and replace it with a plurality of large rigid grates directly on top of the floor structure, and then laying the mineral tiles overtop of the rigid grates usually made of plastic, fiberglass or metal. This alternate approach adds thickness to the assembly and is also expensive and time consuming.

An improved floor construction that permits laying mineral tiles over a wooden, concrete or steel subfloor without suffering the drawbacks mentioned above is therefore desired.

SUMMARY

According to some embodiments, a flexible support screen configured to support a tile on a top surface of a structure when the flexible support screen is positioned between the top surface of the structure and the tile is described herein. The flexible support screen includes a compressible body having: a top surface having a plurality of upper openings; a bottom surface spaced apart from the top surface, the bottom surface having a plurality of lower openings; and a plurality of channels extending between the top surface and the bottom surface. The plurality of channels are configured to receive a fluid from at least one upper opening of the top surface and direct the fluid through the compressible body to exit through at least one of the lower openings of the bottom surface. The flexible support screen has a variable rate of compression upon receiving a force directed upon either the top surface or the bottom surface of the compressible body.

The flexible support screen may further include a bedding layer having a compressible body having a top surface configured to engage a bottom surface of the tile and a bottom surface configured to engage a top surface of the compressible body of the flexible support screen.

The bedding layer may have a compressibility that is greater than a compressibility of the compressible body.

The bedding layer may include a closed cell foam that is impervious to water.

The bedding layer may include perforations to provide for water to pass between the top surface of the bedding layer and the bottom surface of the bedding layer.

The bedding layer and the compressible body may be integral with each other.

The bedding layer and the compressible body may be attached to each other.

The bedding layer and the compressible body may be separate from each other.

The compressible body may have a variable rate of compression upon receiving a force directed upon either the top surface of the compressible body or the bottom surface of the compressible body.

The compressible body may include serpentine sections extending between the upper openings and the lower openings to define the channels.

The channels may be arranged in a regular pattern across the flexible support screen.

The channels may be arranged in an irregular pattern across the flexible support screen.

The flexible support screen may be configured to provide a gap between a portion of the bottom surface of the compressible body and the top surface of the structure.

The flexible support screen may include a plurality of protrusions extending downwardly from the bottom surface of the compressible body to provide the gap.

The compressible body may be a sheet made of a resilient elastomeric material that is sufficiently flexible to provide for the sheet to be coiled over a roll core having a diameter of no more than 2" without the flexible support screen cracking, breaking or creasing.

According to some embodiments, a tile spacer for spacing apart adjacent tiles of a tile floor system is described. The tile spacer includes a first side surface for engaging a first tile of the tile floor system and a second side surface opposed to the first side surface, the second side surface for engaging a second tile of the tile floor system, the second tile being adjacent to the first tile. The tile spacer is compressible to absorb movement of the first tile and the second tile towards each other, at least one of the first side surface and the second side surface is coated with an adhesive to adhere the tile spacer to one or more of the first tile and the second tile, and the tile spacer has a height that is less than a height of the adjacent tiles of the tile floor system.

The first side surface and the second side surface may both be coated with the adhesive.

The tile spacer may include a removable tab covering the at least one of the first side surface and the second side surface that is coated with the adhesive According to some embodiments, a tile floor system is described. The system includes a plurality of tiles; a flexible support screen configured to support a tile on a top surface of a structure when the flexible support screen is positioned between the top surface of the structure and the tile as described herein, and one or more tiles spacers as described herein.

These and other features and advantages of the present application will become apparent from the following detailed description taken together with the accompanying drawings. However, it should be understood that the detailed description and the specific examples, while indicating preferred embodiments of the application, are given by way of illustration only, since various changes and modifications within the spirit and scope of the application will become apparent to those skilled in the art from this detailed description.

DESCRIPTION OF THE DRAWINGS

For a better understanding of the various embodiments described herein, and to show more clearly how these various embodiments may be carried into effect, reference will be made, by way of example, to the accompanying drawings which show at least one example embodiment, and which are now described. The drawings are not intended to limit the scope of the teachings described herein.

The skilled person in the art will understand that the drawings, further described below, are for illustration purposes only. The drawings are not intended to limit the scope of the applicant's teachings in any way. Also, it will be appreciated that for simplicity and clarity of illustration, elements shown in the figures have not necessarily been drawn to scale. For example, the dimensions of some of the elements may be exaggerated relative to other elements for clarity. Further aspects and features of the example embodiments described herein will appear from the following description taken together with the accompanying drawings.

DETAILED DESCRIPTION

Various systems or methods will be described below to provide an example of each claimed embodiment. No embodiment described below limits any claimed embodiment and any claimed embodiment may cover systems or methods that differ from those described below. The claimed embodiments are not limited to systems or methods having all of the features of any one systems or methods described below or to features common to multiple or all of the systems or methods described below.

Herein, systems and methods of tile floor constructions are described. The systems and methods described herein are appropriate for use in both interior and exterior applications. In some specific embodiments, the systems and methods described herein are useful in exterior applications where the tile floor constructions are overlaid on an existing structure, such as but not limited to a deck.

Figure 1A:
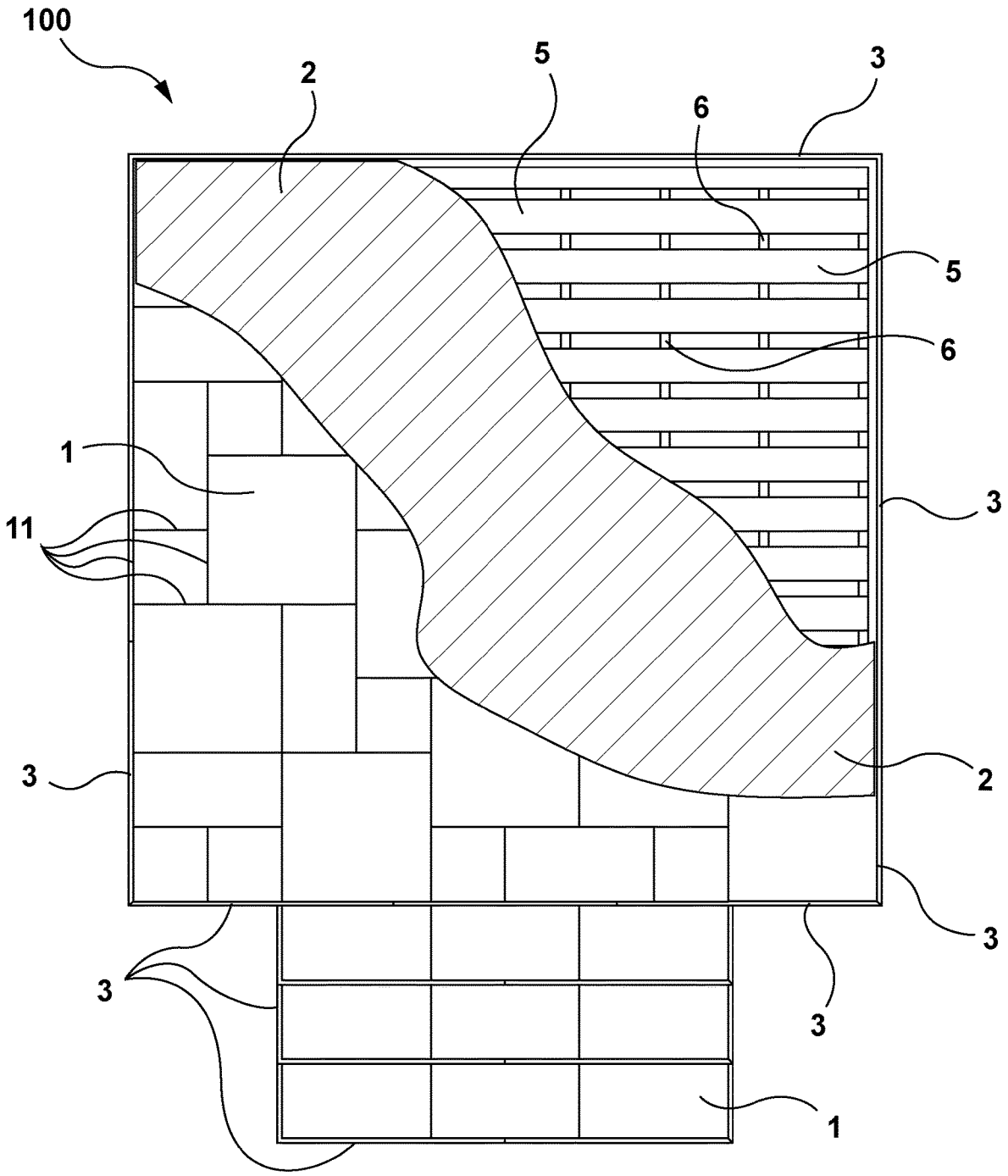
FIG. 1A is a plan view of a tile floor system covering a wooden deck and a three-step staircase showing a flexible support screen and floating tiles, in accordance with one embodiment.

Referring now to the drawings, FIG. 1A is a top view of a floating tile system 100 that overlays a structure, according to one embodiment. In this embodiment, the structure is a pressure treated deck including a series of deck structure floor joists 6 overlaid by a series of pressure treated deck boards 5. Pressure treated deck boards 5 may also be composite boards or the like. In this embodiment, floating tile system 100 includes tiles 1 laid on top of a flexible support screen 2 that is laid directly on a top surface of the pressure treated deck boards 5 to cover the top surface of the pressure treated deck boards 5. The top surface of the embodiment of the flexible support screen 2 shown in FIG. 1A may be generally flat (i.e. smooth and even; without marked lumps or indentations) to engage with at least a portion of each tile 1 and may include openings, as described further below, for receiving and directing water through the flexible support screen 2. Alternatively, in other embodiments, the top surface of the flexible support screen may be substantially flat and may have small (e.g. less than ⅛ inch deep) marked lumps or indentations. The flexible support screen may be a waterproof layer (e.g. non-porous to water).

Tiles 1 are can be made from any material (e.g. ceramic tiles) appropriate for outdoor applications and strong enough for floating applications. For instance, tiles 1 may be referred to as strong tiles. Individual strong tiles may vary in size. For example, in some embodiments, tiles may have a tile area in a range of about 0.2 $ft^2$ to about 32.0 $ft^2$ and an approximate thickness range of ½ inch to one inch.

As further exemplified by FIG. 1A, tiles 1 are laid on top of a flexible support screen 2 that is placed directly on the top surface of the pressure treated deck boards 5. As mentioned above, in this embodiment, tiles 1 are floating tiles (i.e. not adhered to flexible support screen 2 by adhesive, cement, mortar or other similar means). Flexible support screen 2 therefore acts similarly to the way that bedding sand acts in a paver stone driveway application and provides a flexible surface that is stable to support the tiles 1 while also absorbing movement of the underlying surface. Gaps 11 are desired between adjoining tiles 1. These gaps 11 permit the tiles 1 to move slightly horizontally and vertically with respect to each other as weight is applied to individual tiles 1 or as the pressure treated deck boards 5 shift (as is known to occur with pressure treated floor boards over time), without grinding, cracking or chipping adjacent tiles. Gaps 11 can be controlled by appropriate spacers. Gaps 11 may also permit water and/or other liquid that falls onto a top surface of the tiles 1 to drain off the top surface of the tiles 1.

Figure 1B:
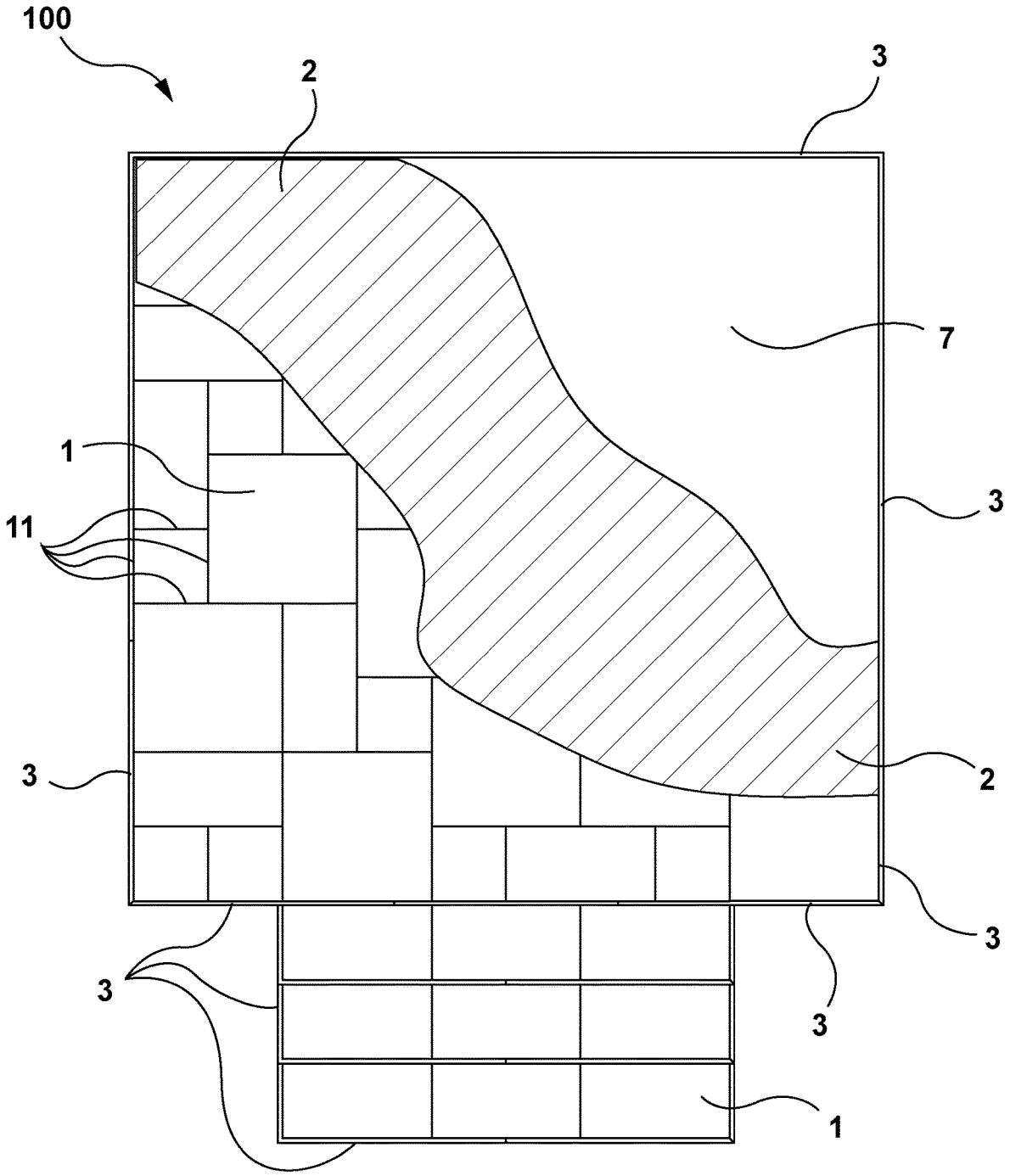
FIG. 1B is a plan view of another embodiment of a tile floor system covering a raised concrete patio and a three-step staircase showing a flexible support screen and floating tiles.

System 100 also includes skirting tiles 3 that are placed around an outer edge of the structure. Skirting tiles 3 extend above pressure treated deck boards 5 to create a horizontal retention for the field of tiles 1. Skirting tiles 3 are generally made from mineral materials but can also be made of wood, metal, composite, etc. Skirting tiles 3 are coupled (e.g. mounted or hung) on side surfaces of the structure. Skirting tiles 3 retain the floor tiles 1 on the top surface of the structure and inhibit the tiles 1 from falling off the top surface of the structure FIG. 1B shows a top view of a floating tile system 200 according to another embodiment where the tiles 1 overlay a raised concrete patio 7 in an exterior environment. Herein, the term "raised" refers to any structure above grade that needs lateral support. In the FIG. 1B, the raised concrete patio 7 replaces the pressure treated deck boards 5 and the deck joists 6 of FIG. 1A.

Figure 1C:
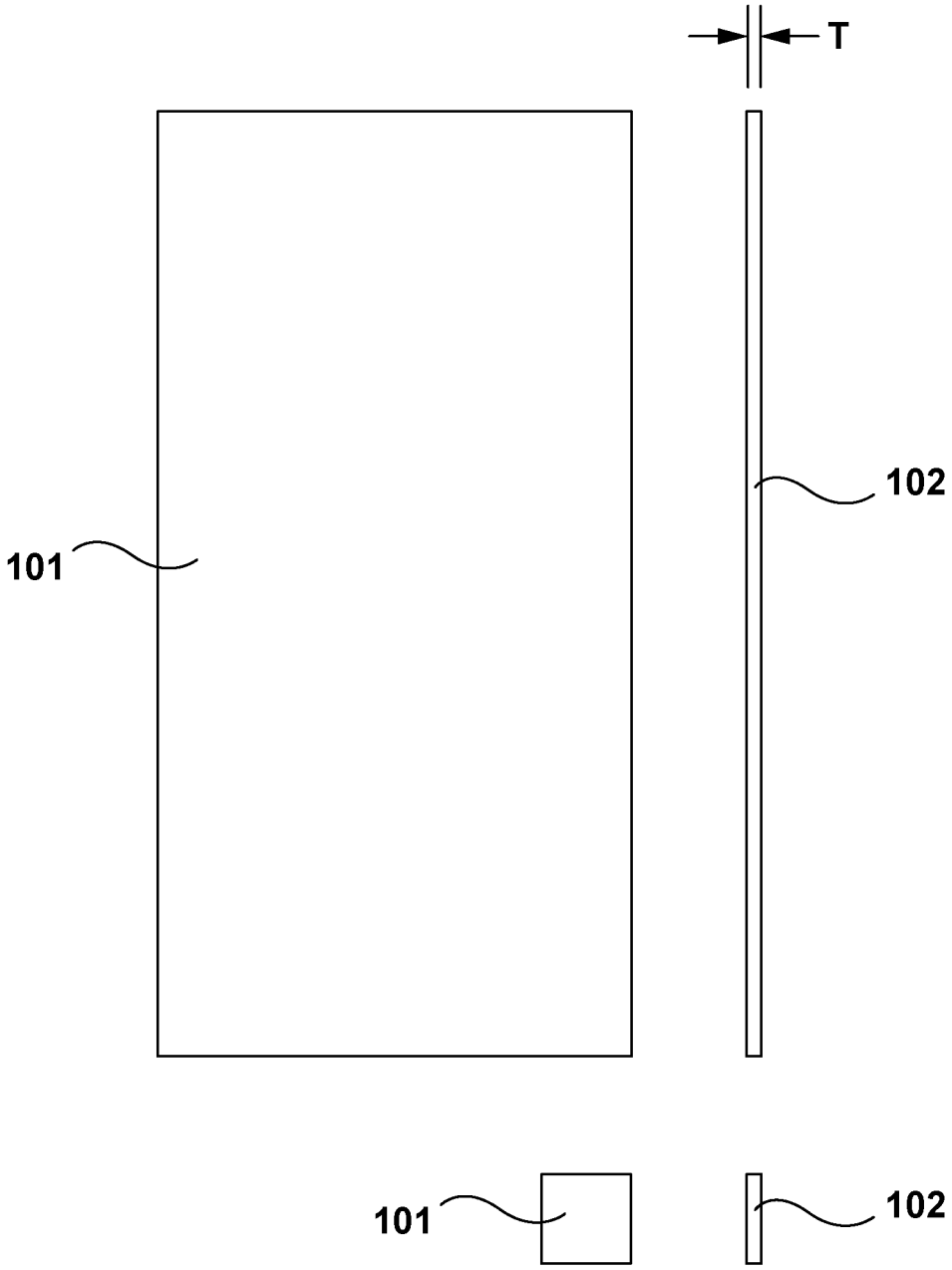
FIG. 1C shows top and side views of a strong tile

FIG. 1C shows top and side views of tiles 1 having a top face 101 and a thickness 102. In the embodiment shown, each tile has an approximate minimum weight of about 5 $lbs/ft^2$ and an approximate maximum weight of about 10 $lbs/ft^2$. Tiles 1 each have an approximate minimum top face surface area of 0.2 $ft^2$ and an approximate maximum top face surface area of 32.0 $ft^2$. Tiles 1 also each have a maximum length of about 96 inches and a minimum tile thickness of about 7/16 inches.

In some installations, tiles 1 have been installed on support points (e.g. pedestals) having, for example, up to 24-inch centers or 12-inch support centers. Tiles 1 installed on these support points will withstand normal pedestrian traffic safely without breaking.

FIGS. 2A, 2B, 2C and 2D show side profile views of various embodiments of edge retaining options for floating tile system 100 and for floating tile system 200 and floating tile system 300 for both exterior and interior applications. The edge retention options shown therein can be made from a wide variety of materials including but not limited to mineral, metals, woods, plastics, composites, etc. The various embodiments are shown in specific applications, but each embodiment can work in each application.

Figure 2A:
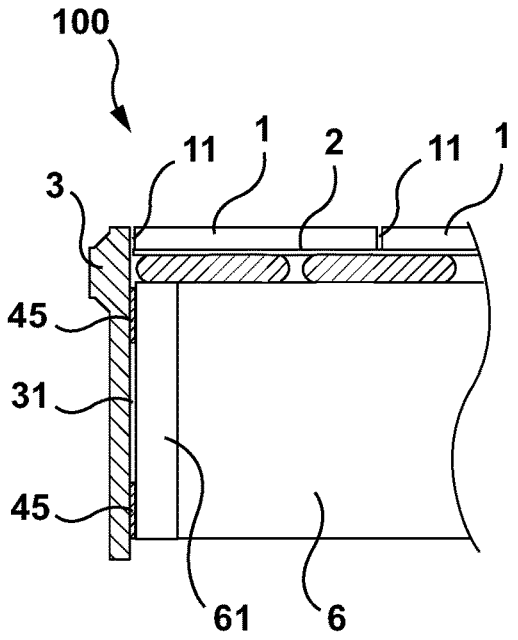
FIGS. 2A, 2B, 2C and 2D are cross sectional views of field tile retention embodiments

FIG. 2A shows a profile view of one embodiment of the skirting tile 3. Skirting tile 3 is offset from the pressure treated deck structure rim board 61 by spacer 45 and creates a drainage gap 31 between the pressure treated deck structure rim board 61 and skirting tile 3.

Figure 2B:
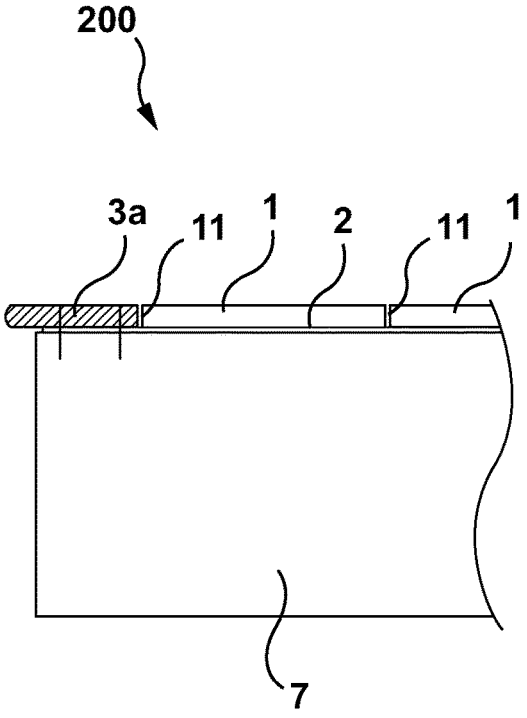

FIG. 2B depicts a wide transition strip 3*a* that may be utilized in both interior and exterior applications as a retention system.

Figure 2C:
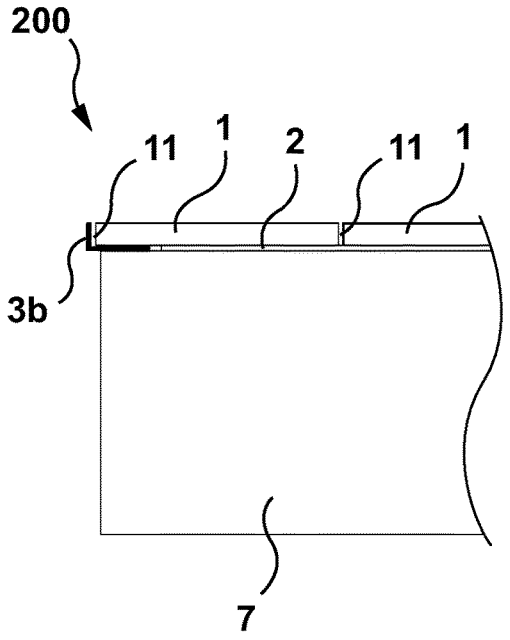

FIG. 2C depicts a simple angle 3*b* that may be utilized in both interior and exterior applications as a retention system.

Figure 2D:
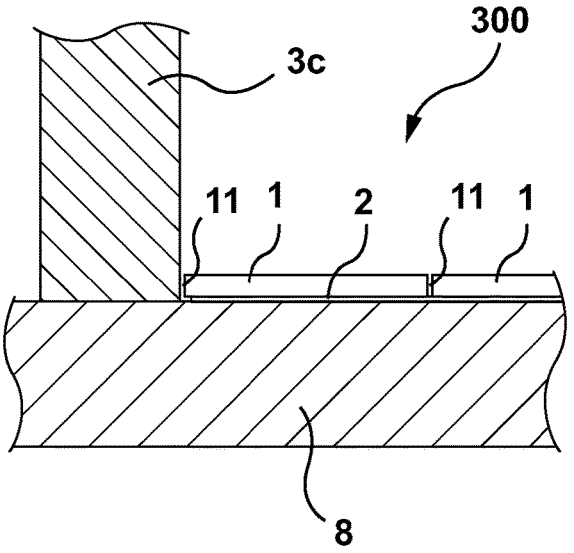

FIG. 2D shows system 300 being a floor and wall construction for both interior and exterior applications. In system 300, wall 3*c* functions as retention system for field tile.

Figure 3A:
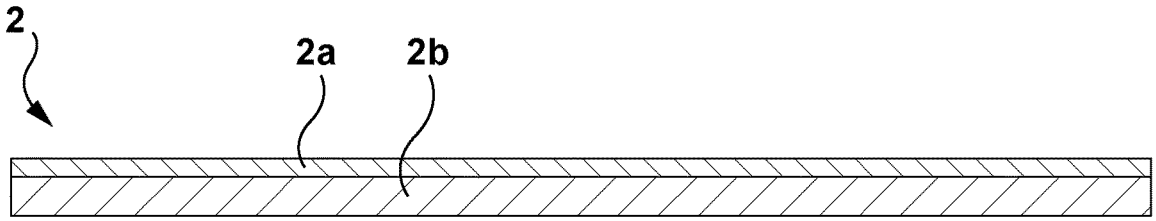
FIG. 3A is side view of a support screen.
Figure 3B:
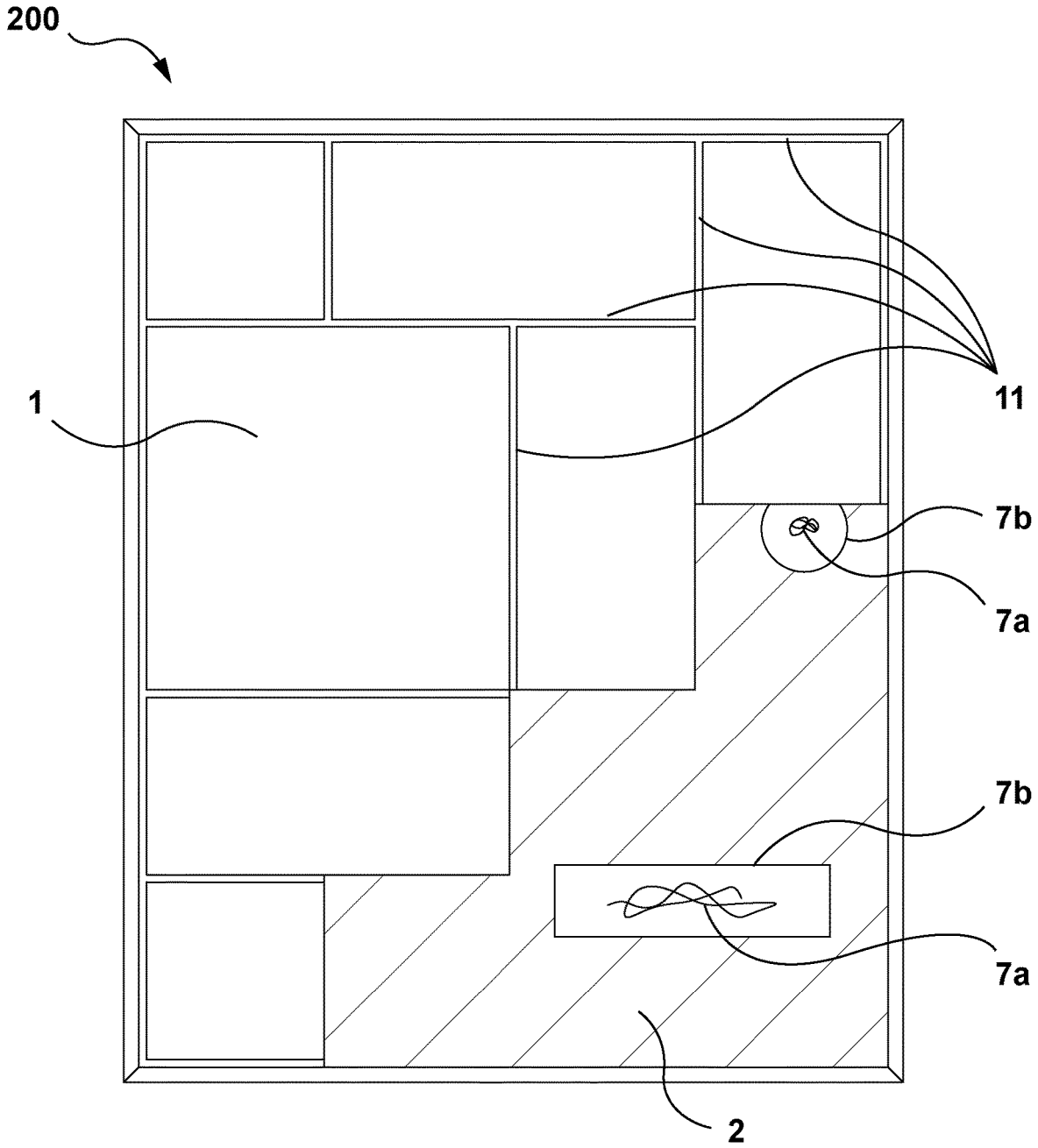
FIG. 3B is a plan view of another embodiment of a tile floor system covering a raised concrete patio a flexible support screen and floating tiles.

FIG. 3A and FIG. 3B show a flexible support screen 2, according to one embodiment. Generally, flexible support screen 2 may be made of any one or more natural or artificial, flexible materials (e.g. polymers or elastomers) that can be laid on top of a structure to support tiles 1 thereon. Flexible support screen 2 is configured to be compressible (within normal indoor and outdoor environmental conditions) upon receiving a load of sufficient magnitude on its top or bottom surface. For instance, flexible support screen 2 is generally compressible to accommodate to a top surface of the structure upon which it is laid. Flexible support screen 2 is generally formulated to remain resilient and flexible in a wide range of temperatures commonly found in indoor and/or outdoor environments. Flexible support screen 2 may have a gummy (i.e. sticky) texture, such as but not limited to being like rubber. For instance, in some embodiments, flexible support screen 2 may include a butadiene-based rubber material. In other embodiments, flexible support screen 2 may include recycled rubber tires (e.g. a styrene-butadiene copolymer). Due to the "sticky" or gummy nature of some of the embodiments of the flexible support screen 2 described herein, mortar or adhesive are not required to secure the tiles 1 to flexible support screen 2. In other embodiments, the flexible screen may include a textile material that is produced by matting, condensing and pressing fibers together. In other embodiments, the flexible screen may include natural fibers such as wool or animal fur, or from synthetic fibers.

FIG. 3A shows the side view of one embodiment of the flexible support screen 2. Flexible support screen 2 may include two distinct layers: a bedding layer 2*a* and a drainage/conformity layer 2*b*. The bedding layer 2*a* is generally soft and slightly sticky and is compressible to allow tile 1 to bed itself into bedding layer 2*a* and resist lateral movement. The bedding layer 2*a* can be free draining or waterproof depending on the intended application. To provide for bedding layer to be free draining, bedding layer 2*a* may include perforations or channels to direct water therethrough.

The drainage/conformity layer 2*b* is firmer (i.e. has a lower compressibility) than the bedding layer 2*a* to support the tiles thereon above the structure yet is elastic and designed to conform to the structural base of the deck and provide a relatively flat surface for bedding layer 2*a* and tiles 3. The drainage/conformity layer 2*b* is also designed to provide an air gap between field tiles 1 and the structural base of system 100 and system 200 in order to provide pathways for water in free-draining applications. The bedding layer 2*a* and the drainage/conformity layer 2*b* can be integral with each other, separate layers that are bonded together or installed independently. The bedding layer 2*a* and the drainage/conformity layer 2*b* can be made of the same material or distinct materials. It is desirable that flexible support screen 2 is relatively thin, such as in a range of about 0.100 inches to about 0.500 inches The drainage/conformity layer 2*b* generally is generally rigid enough to receive forces from either above or below (e.g. from the weight of one or more tiles and/or pedestrian traffic) and maintain an ability for a fluid to transfer vertically though the drainage/conformity layer and laterally across the underlying surface (either within the drainage/conformity layer or after the fluid passes through the drainage/conformity layer).

FIG. 3B shows the top view of one embodiment of the flexible support screen 2 being overlaid with field tiles 1 on a concrete porch. Field tiles 1 are separated by gaps 11. For the field tiles 1 to lay flat, the structural base of system 100 and system 200 and system 300 must also be flat, but these structural bases occasionally have localized areas that are high points as a result of wood cupping or concrete cracks or other issues 7*a* on which tiles 1 might teeter. Flexible support screen 2 is designed to absorb most high points. Occasionally these localized high points are too extreme, in which case, the flexible support screen 2 can be easily cut away 7*b* with a utility knife to alleviate the area of pressure, allowing field tile 1 to lay flat and on plane with other field tiles 1.

FIG. 4A through 4D depict various embodiments of bedding layer 2*a*. It should be noted that bedding layer 2*a* can be made of various materials suitable for the application. Generally, bedding layer 2*a* may be made of natural or artificial, flexible materials (e.g. polymers, elastomers, felts etc.) that can be laid on top of a structure to support tiles 1 thereon. Bedding layer 2*a* is configured to be compressible (within normal indoor and outdoor environmental conditions) upon receiving a load of sufficient magnitude on its top or bottom surface. For instance, bedding layer 2*a* is generally compressible to accommodate to a top surface of the structure upon which it is laid. Bedding layer 2*a* is generally formulated to remain resilient and flexible in a wide range of temperatures commonly found in indoor and/or outdoor environments. Bedding layer 2*a* may have a gummy (i.e. sticky) texture, such as but not limited to being like rubber. For instance, in some embodiments, bedding layer 2*a* may include a natural or artificial felt. In other embodiments, bedding layer 2*a* may include recycled rubber tires (e.g. a styrene-butadiene copolymer).

Bedding layers as depicted in 4A through 4D may provide conformity and lateral adhesion between the tiles resting on their upper surface and the support layer beneath them. Bedding layers 4A through 4D are relatively thin, generally between 0.030 inch and 0.125 inch thick. Bedding layer 2*a* is more compressible than drainage/conformity layer 2*b*. Bedding layers 4A through 4D are comprised of very soft material, typically with hardness ranging between a minimum of Shore OO Scale 50 to a maximum of Shore A Scale 40. A further desirable characteristic of the bedding layer material is a coefficient of static friction of at least 0.8 when in contact with the underside of ceramic tile and also with the top of the flexible support screen. This combination of characteristics may result in a good lateral grip between the bedding layer and the tiles above it and also between the bedding layer and the flexible support screen below it, even at the low contact pressures arising from the weight of the tiles themselves. The lateral grip between the tile and the bedding layer and the bedding layer and the flexible support screen may work to enhance the stability of the system.

Figure 4A:
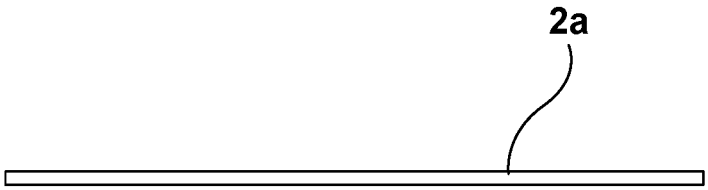
FIG. 4A is a side view of one embodiment of a bedding layer.
Figure 4B:
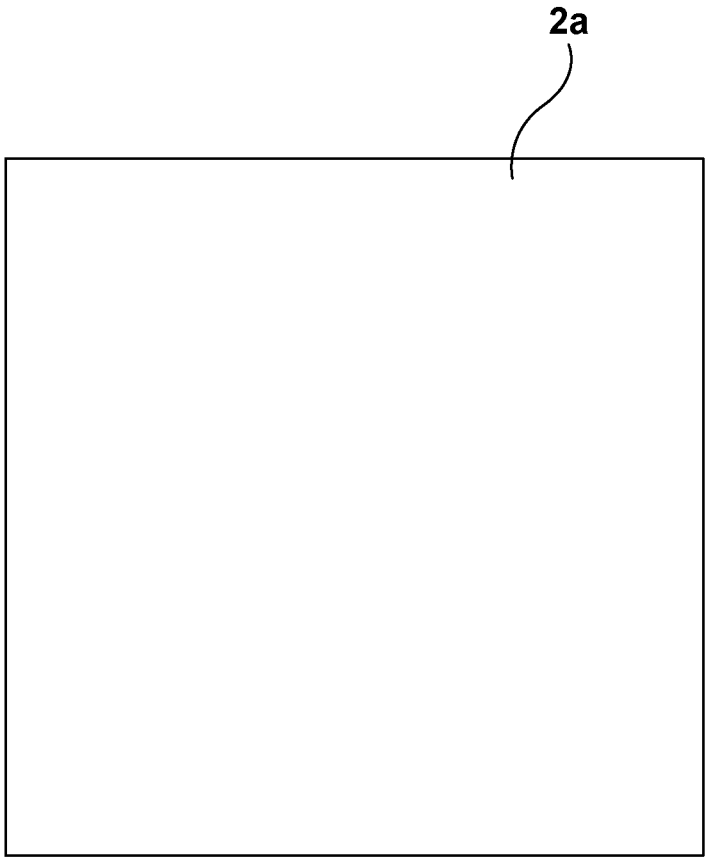
FIG. 4B is a plan view of the bedding layer of FIG. 4A.
Figure 4C:
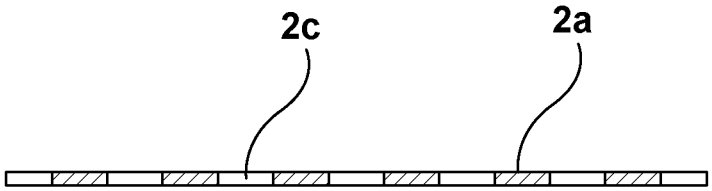
FIG. 4C is a side view of another embodiment of a bedding layer.
Figure 4D:
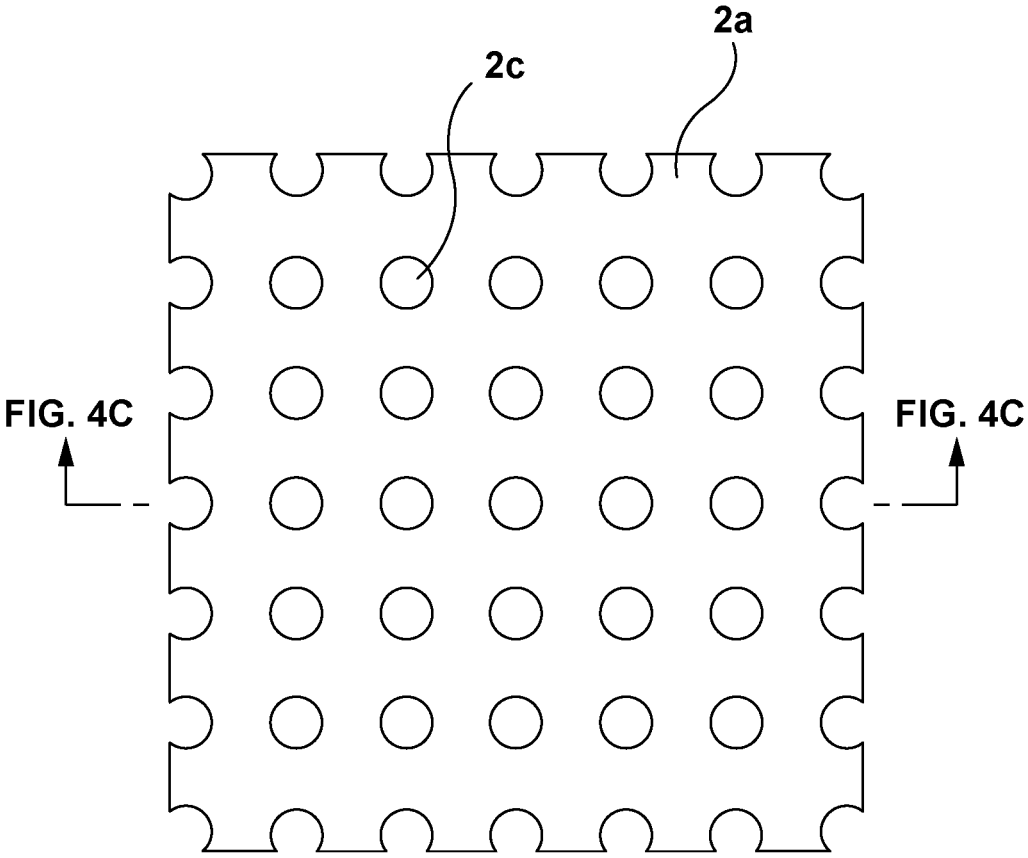
FIG. 4D is a plan view of the bedding layer of FIG. 4C.

FIGS. 4A and 4B depict side and top views of one embodiment of the bedding layer 2*a* that is made from closed-cell foam that is impervious to water and is intended for waterproof application FIGS. 4C and 4D depict side and top views of one embodiment of the bedding layer 2*a* that is also made from closed-cell foam that includes perforations 2C for free draining applications.

FIG. 5A through 9F depict various embodiments of drainage/conformity layers of the flexible support screen 2. Each embodiment of drainage/conformity layer described below may be included in a floating tile system described herein to provide a flexible upper surface that is stable to support the tiles 1 and absorb movement of an underlying surface without a corresponding bedding layer 2*a*. Alternatively, each drainage/conformity layer described herein may be included in a floating tile system described herein to provide a flexible upper surface that is stable to support the tiles 1 and absorb movement of an underlying surface with a corresponding bedding layer 2*a* positioned on top of the drainage/conformity layer. In some embodiments, the drainage/conformity layers described herein may be integral with a respective bedding layer described herein. In some embodiments, the drainage/conformity layers described herein may be made of a same elastomeric material or materials as a respective bedding layer described herein. In some embodiments, the drainage/conformity layers described herein may be independent and/or separate from a respective bedding layer described herein.

It should be noted that the drainage conformity layers described herein can be made of various materials suitable for the application. Generally, drainage conformity layers may be made of natural or artificial, flexible materials (e.g. polymers or elastomers) that can be laid on top of a structure to support tiles 1 thereon. Drainage conformity layers are configured to be compressible (within normal indoor and outdoor environmental conditions) upon receiving a load of sufficient magnitude on its top or bottom surface. For instance, drainage conformity layers are generally compressible to accommodate to a top surface of the structure upon which it is laid. Drainage conformity layers are generally formulated to remain resilient and flexible in a wide range of temperatures commonly found in indoor and/or outdoor environments. Drainage conformity layers may have a gummy (i.e. sticky) texture, such as but not limited to being like rubber. For instance, in some embodiments, drainage conformity layers may include a butadiene-based rubber material. In other embodiments, drainage conformity layers may include recycled rubber tires (e.g. a styrene-butadiene copolymer).

It should also be noted that herein, the term "surface", when referring to the top surface and/or the bottom surface of the drainage/conformity layer, refers to the uppermost or lowermost, respectively, extent of the layer. For instance, the top surface and may not be a continuous surface but rather may be a collection of contact points between the drainage/conformity layer and a structure laid thereupon (e.g. a tile or the bedding layer).

Figure 5A:
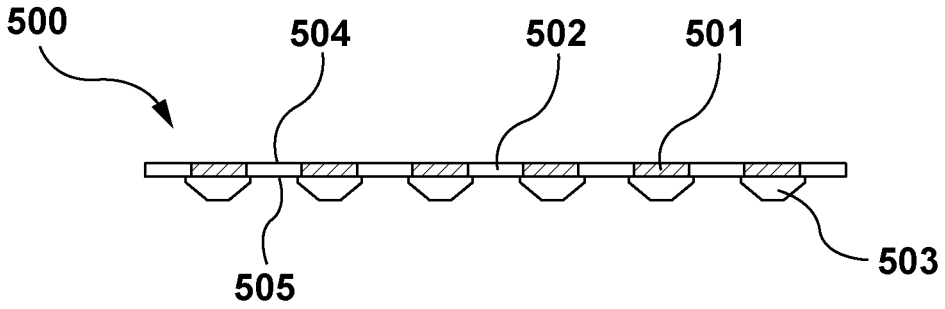
FIGS. 5A and 5B are side and top views, respectively, of one embodiment of a drainage/conformity layer.
Figure 5B:
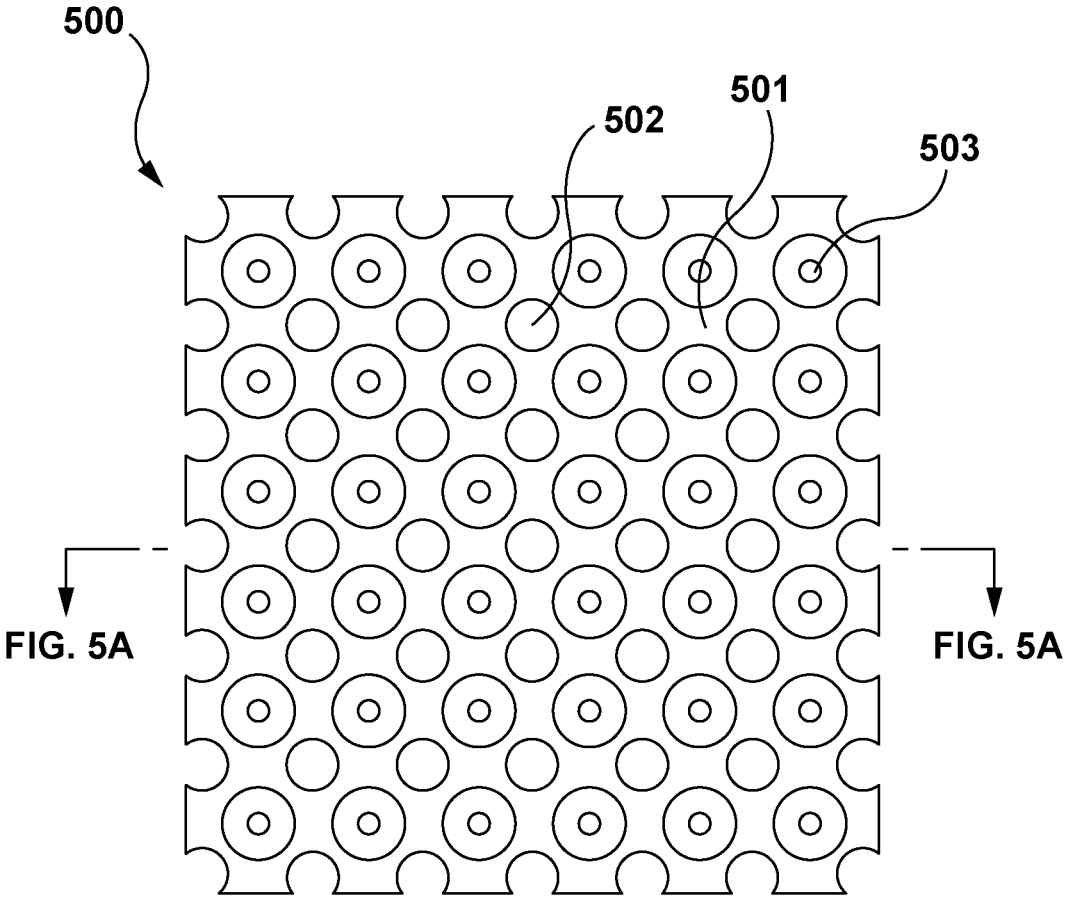

FIGS. 5A and 5B show side and top views, respectively, of one embodiment of a drainage/conformity layer. Drainage/conformity layer 500 includes a sheet portion 501 having a top surface 504 and a bottom surface 505 and channels 502 extending therebetween. Sheet portion 501 may be analogous to bedding layer 2*b* as described in FIG. 4B. Channels 502 specifically extend between one of a plurality of openings in the top surface 504 and one of a plurality of openings in the bottom surface 505. Channels 502 are shown as each being defined by a sidewall that extends vertically between the top surface 504 and the bottom surface 505. Channels 502 are also shown as having a circular shape and as being arranged in a regular pattern (i.e. having about equidistant spacing between adjacent channels) throughout the drainage/conformity layer 500, but openings 502 may have any shape and may be irregularly arranged (i.e. having variable spacing between adjacent channels) through drainage/conformity layer 500. Channels 502 are shown as being perpendicular to top surface 504 and bottom surface 505 of the sheet portion 501 (i.e. each sidewall is perpendicular to top surface 504), but channels 502 may have any shape as they extend between the top surface 504 and the bottom surface 505. Channels 502 generally have a diameter to provide for water to freely pass from the top surface 504 to the bottom surface 505.

Drainage/conformity layer 500 also includes protrusions 503 extending downwardly from sheet portion 501. Protrusions 503 support the bottom surface 505 of the layer 500 above a top surface of the structure when the layer 500 is placed on top of the structure. Protrusions 503 are shown as having a same diameter and being arranged in a regular pattern across the bottom surface 505 of the drainage/conformity layer 500, but protrusions 503 may be irregularly arranged across the bottom surface 505.

Protrusions 503 may have a conical shape that provides for protrusions 503 to act as individual variable rate springs. For instance, when a load is applied to the drainage/conformity layer 500, individual protrusions 503 may compress to absorb the load and inhibit deflection of the top surface 504 in areas other than directly beneath the load. Further, when water passes through the openings 502 as described above, protrusions 503 support the bottom surface 505 at a position above the top surface of the structure such that the water may pass out of the bottom surface 505 and travel in any direction along the top surface of the structure.

Further, protrusions 503 may provide for the drainage/conformity layer 500 to deform slightly and maintain a planar top surface 504 if the structure below the drainage/conformity layer 500 shifts. For instance, if the structure below the drainage/conformity layer 500 shifts upwardly slightly (e.g. by a distance less than about ⅓ of the natural thickness of the drainage/conformity layer 500), individual protrusions 503 may compress to absorb the upward movement of the structure without shifting the top surface 504 or any tiles thereon. Further, when the drainage/conformity layer 500 is compressed, if the structure below the drainage/conformity layer 500 shifts downwardly slightly (e.g. by a distance less than about ⅓ of the thickness of the drainage/conformity layer 500), individual protrusions 503 may decompress to accommodate for the downward movement of the surface and maintain conformance of the drainage/conformity layer 500 without shifting the top surface 504 or any tiles thereon.

In some embodiments, protrusions 503 and sheet portion 501 may be made of different elastomeric materials that are bonded together. In other embodiments, protrusions 503 and sheet portion 501 may be made of a same elastomeric material and integral with each other.

Figure 6A:
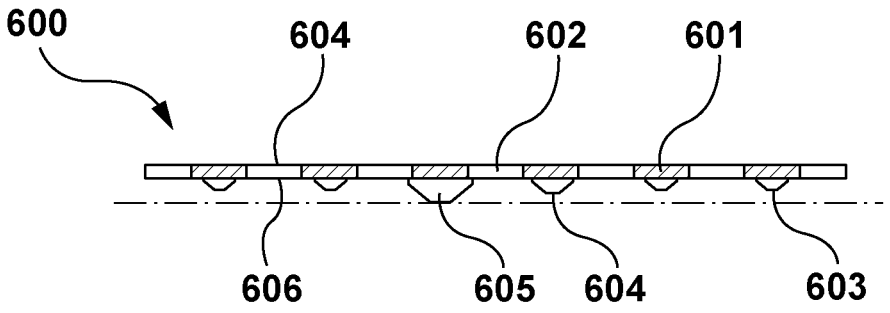
FIGS. 6A and 6B are side and top views, respectively, of another embodiment of a drainage/conformity layer.
Figure 6B:
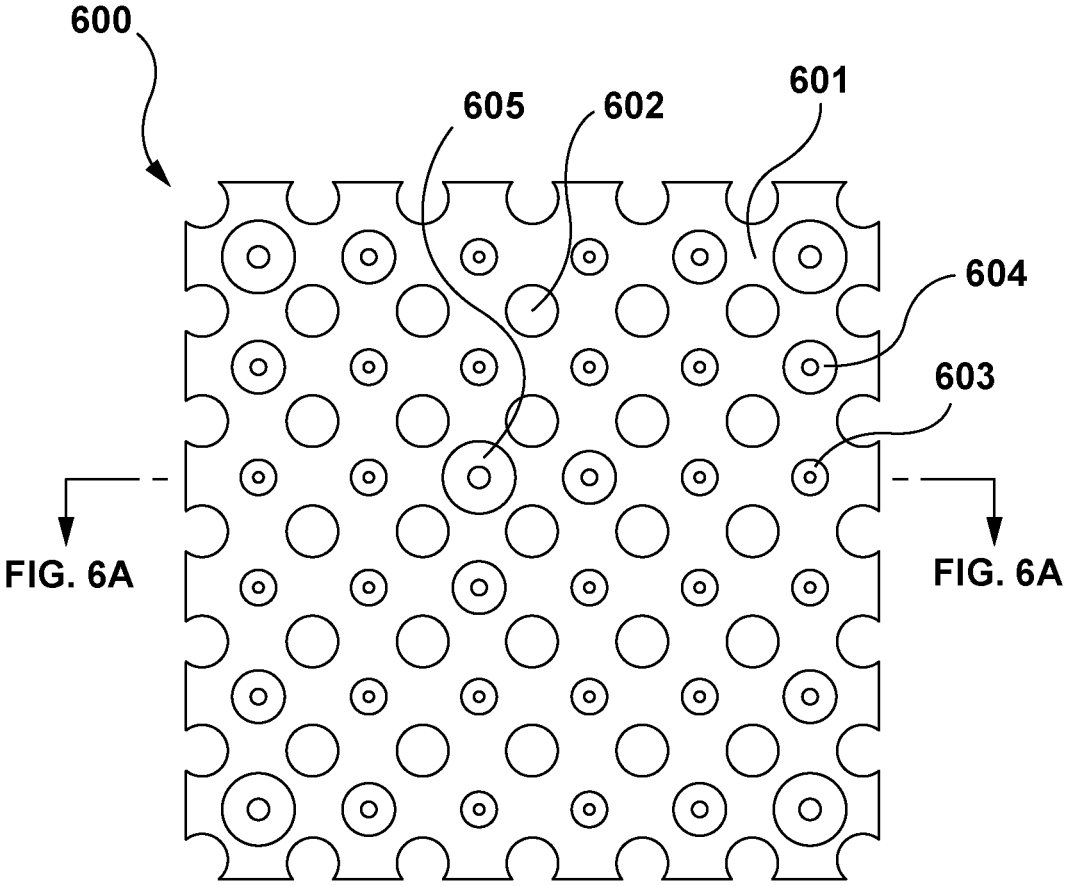

FIGS. 6A and 6B show a side and top views, respectively, of another embodiment of a drainage/conformity layer 600 in which a top sheet portion 601 has channels 602 extending therethrough and protrusions 603, 604 and 605 extend downwardly from a bottom surface 606 of the top sheet portion 601.

In this embodiment, protrusions 603, 604 and 605 are each dimensioned to contribute to drainage/conformity layer 600 acting as a variable rate spring (i.e. resistance of the drainage/conformity layer 600 to compression varies during compression). For instance, protrusions 605 are relatively larger (e.g. have a greater diameter and/or height) than protrusions 604, and protrusions 604 are relatively larger (e.g. have a greater diameter and/or height) than protrusions 603.

As shown, protrusions 603, 604 and 605 are dispersed across bottom surface 606 so that there are fewer large-size protrusions 605 than medium-size protrusions 604 and fewer medium-size protrusions 604 than small-size protrusions 603. Protrusions 603, 604 and 605 can be arranged in a regular pattern across bottom surface 606 or can be randomly arranged across bottom surface 606. When protrusions 605 have a greater height than protrusions 604 and protrusions 604 have a greater height than protrusions 603, when a tile is placed on top of the drainage/conformity layer 600, the protrusions 605 contacting the upper surface of the structure will compress slightly and distribute the weight of the tile over the protrusions 605. As weight is added to the tile (e.g. as a person steps on the tile), the protrusions 605 compress further, the bottom surface of the drainage/conformity layer 600 moves closer to the top surface of the structure and the protrusions 604 begin to contact the top surface of the structure and absorb some of the added weight. Accordingly, the resistance of the drainage/conformity layer 600 increases. As further weight is added to the top surface of the drainage/conformity layer 600, the protrusions 604 and 605 compress further, the bottom surface of the drainage/conformity layer 600 moves even closer to the top surface of the structure and the protrusions 603 begin to contact the top surface of the structure and absorb some of the additional weight. Accordingly, the resistance of the drainage/conformity layer 600 increases again. In this way, the drainage/conformity layer 600 will have the ability to deflect a considerable amount initially and become relatively stiff quickly. As a result, drainage/conformity layer 600 may accommodate to uneven structural surfaces and pedestrian traffic forces, for example.

Further, protrusions 603, 604 and 605 may provide for the drainage/conformity layer 600 to maintain a flat top surface if the structure below the drainage/conformity layer 600 shifts or moves. For instance, if the structure below the drainage/conformity layer 600 shifts upward, individual protrusions 603, 604 and 605 may compress to absorb the upward movement of the structure without shifting the top surface or any tiles thereon. Further, when the drainage/conformity layer 600 is compressed, if the structure below the drainage/conformity layer 600 shifts downwardly, individual protrusions 603, 604 and 605 may decompress to maintain a planar position of the top surface 504 and any tiles thereon.

As noted above with reference to FIGS. 5A and 5B, water (or other liquids) may pass through the channels 602, out of the bottom surface 606 and travel in any direction along the top surface of the structure.

Figure 7A:
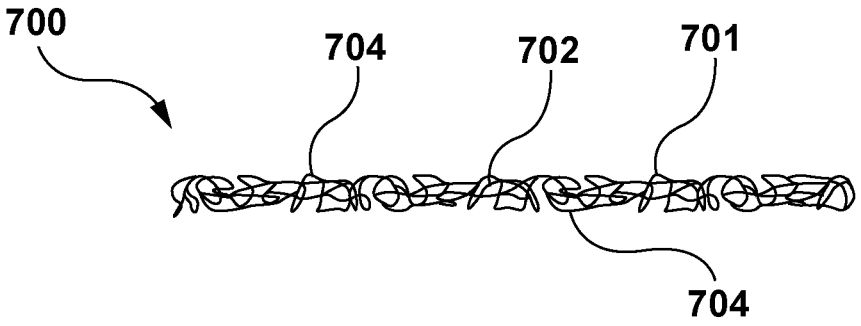
FIGS. 7A and 7B are side and top views, respectively, of another embodiment of a drainage/conformity layer.
Figure 7B:
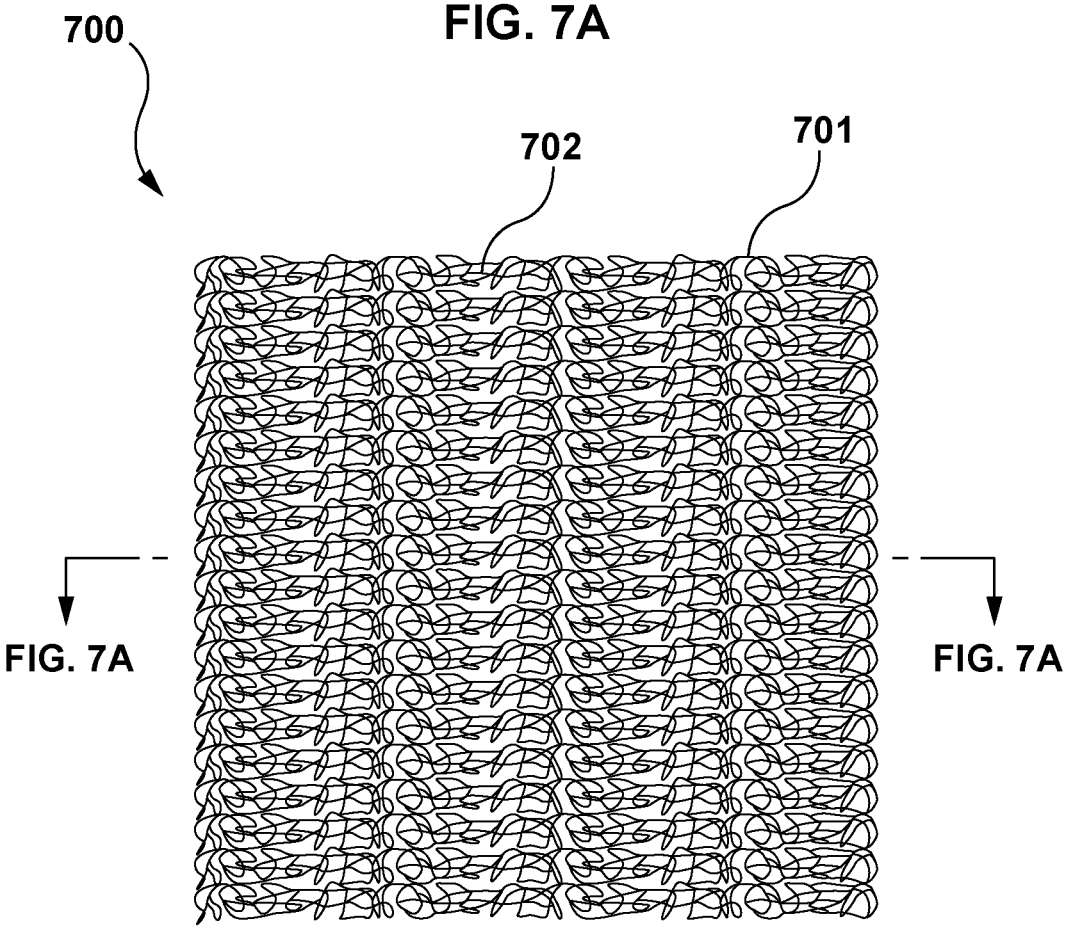

FIGS. 7A and 7B show side and top views, respectively, of another embodiment of a drainage/conformity layer 700, in which the drainage/conformity layer 700 is constructed from elastomeric strands 701 woven into planar sheet having a top surface 703 having upper openings, a bottom surface 704 having lower openings and channels 702 extending between the top surface 703 and a bottom surface 704. Channels 702 generally have a path length that is greater than a thickness of the drainage/conformity layer 700. In some embodiments, the elastomeric strands are separated by a distance in a range of about 0.1 mm to about 100 mm.

When water is placed on top surface 703 it proceeds to pass through the upper openings, fall through the channels 702 and exit the drainage/conformity layer 700 via the lower openings onto a top surface of the structure underlying the drainage/conformity layer 700. As water lands on the top surface of the structure, it is free to travel in any direction along the top surface of the structure as at least some of the lower openings are spaced apart from the top surface of the structure (i.e. bottom surface 704 is discontinuous (e.g. portions of the bottom surface 704 are spaced from the top surface of the structure)). As a force is applied to the top surface 703 by the weight of a tile or pedestrian traffic, the channels 702 provide for the drainage/conformity layer 700 to compress, the elastomeric strands 701 meet one another and form a flexible yet pervious structure. Further, drainage/conformity layer 700 can provide for the tiles to remain in a planer orientation as the structure below the drainage/conformity layer 700 shifts and moves.

The size and durometer of strands 701 coupled with the size and frequency of air channels 702 combine to create a bed for tiles 1 while accommodating uneven structural surfaces and pedestrian traffic forces.

Further, drainage/conformity layer 700 may also accommodate to a shifting lower structure below the drainage/conformity layer 700. For instance, if the structure below the drainage/conformity layer 700 shifts upwardly, portions of the drainage/conformity layer 700 may compress to absorb the upward movement of the structure without shifting the top surface or any tiles thereon. Further, when the drainage/conformity layer 700 is compressed, if the structure below the drainage/conformity layer 700 shifts downwardly, portions of the drainage/conformity layer 700 may decompress to maintain a planar position of the top surface and any tiles thereon.

Figure 8A:
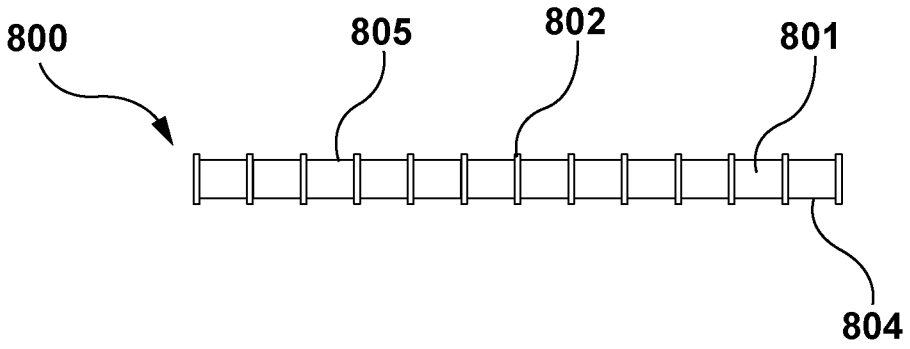
FIGS. 8A and 8B are side and top views, respectively, of another embodiment of a drainage/conformity layer.
Figure 8B:
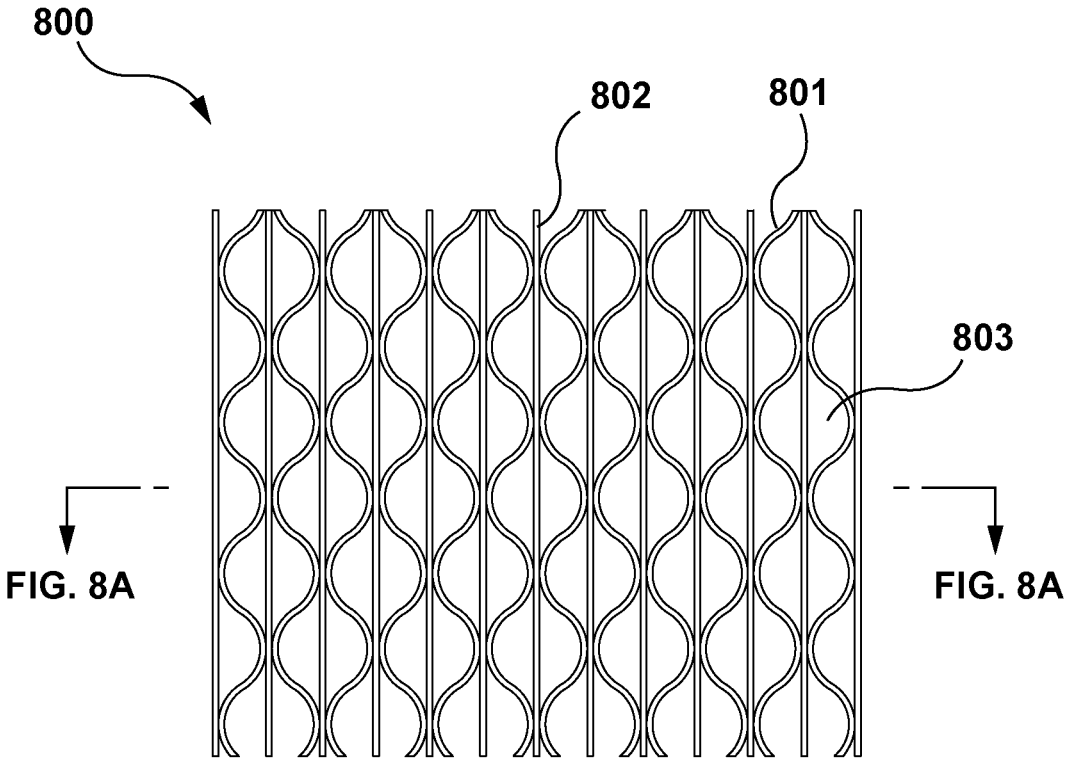

FIGS. 8A and 8B show side and top views, respectively, of another embodiment of a drainage/conformity layer 800. In this embodiment, drainage/conformity layer 800 is constructed of elastomeric ribbons including straight sections of elastomeric ribbons 802 and connected serpentine (i.e. move or lie in a winding path or line) sections of elastomeric ribbon 801. Straight sections of elastomeric ribbons 802 and connected serpentine sections of elastomeric ribbon 801 are arranged in a regular pattern to form channels 803 therein that provide for the passage of water through the layer 800. Channels 803 are generally perpendicular to the top surface of the drainage/conformity layer 800. FIG. 8B shows the channels 803 created by the arrangement of the straight sections of elastomeric ribbons 802 and connected serpentine sections of elastomeric ribbon 801. In some embodiments, the channels 803 have a width in a range of about 1 mm to about 100 mm.

As per FIG. 8A, straight sections 802 are slightly taller than connected serpentine sections 801 and thereby create channels 804 on the bottom of drainage/conformity layer 800. Water that passes through channels 804 is free to escape in the direction parallel to straight sections 802. Straight sections 802 should therefore be oriented in a direction parallel to a direction of desired water drainage.

In some embodiments, serpentine sections 801 are structurally stronger than straight sections 802 when receiving forces from weight of the tiles and/or pedestrian traffic. Regions where the straight sections 802 and serpentine section 801 connect may be even stronger. The parts of straight sections 802 at the top and bottom of the drainage/conformity layer 800 which make up channels 804 and 805 are unsupported and easily deflect to create a bed for tiles 1 while accommodating uneven structural surfaces and pedestrian traffic forces as outlined in FIGS. 10E and 10F.

Figure 9A:
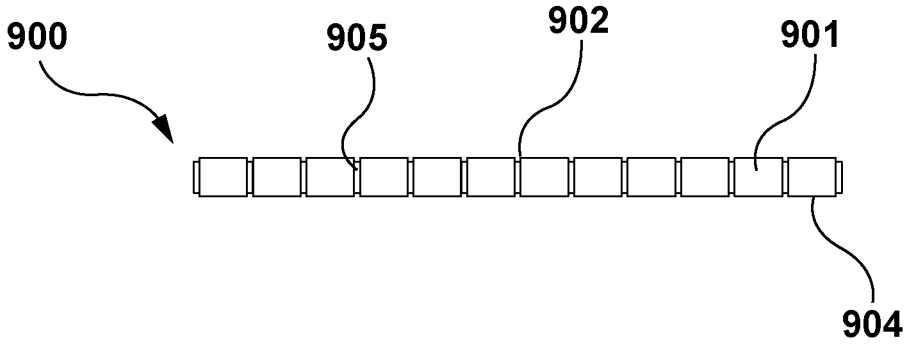
FIGS. 9A and 9B are side and top views, respectively, of another embodiment of a drainage/conformity layer.
Figure 9B:
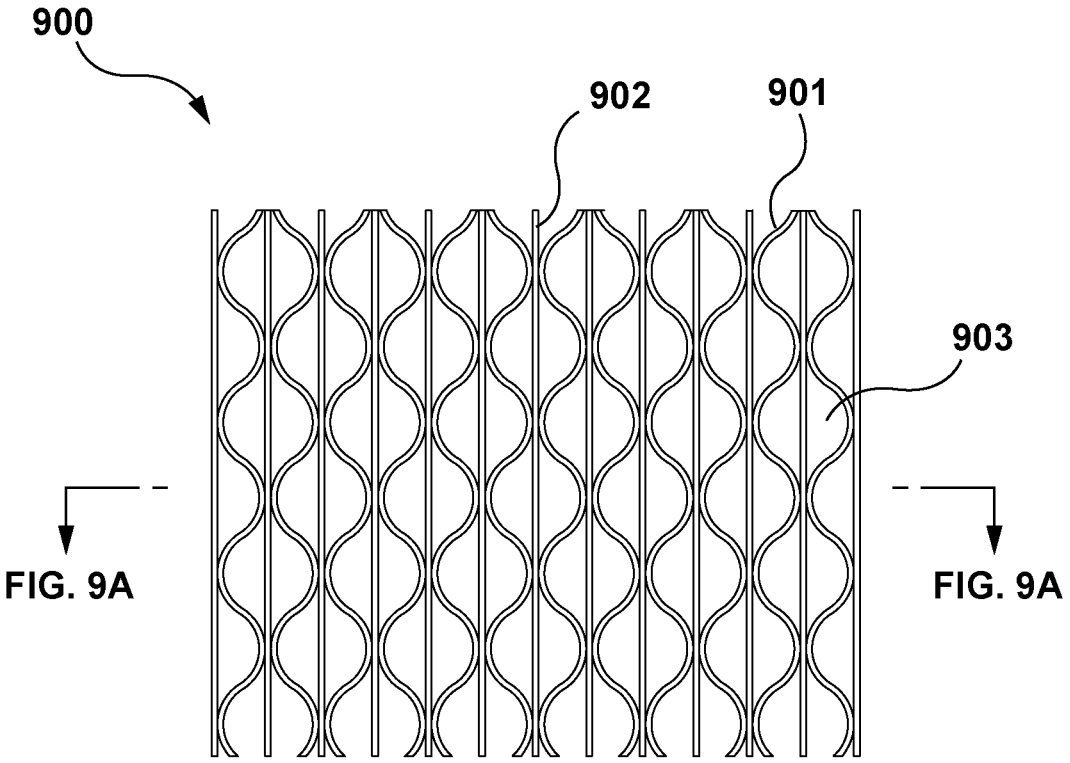

FIGS. 9A and 9B show side and top views, respectively, of an embodiment of drainage/conformity layer 900 in which drainage/conformity layer 900 is constructed of elastomeric ribbons in the form of straight sections 901 and connected serpentine sections 902. In a manner similar to FIG. 8A, straight sections 901 are slightly shorter than connected serpentine sections 902 and thereby create channels 904 on the bottom of drainage/conformity layer 900. Water that passes through channels 903 is free to pass through the channels 904 in a direction parallel to straight sections 901. For this reason, the straight sections 901 of drainage/conformity layer 900 are oriented in a direction perpendicular to a direction of desired water drainage.

Again, serpentine sections 902 are structurally stronger than straight sections 901 in the direction of forces from tile weight and pedestrian traffic. Connected areas of straight section 901 and serpentine section 902 are stronger still. The parts of serpentine sections 902 at the top and bottom of the screen which make up channels 904 and 905 are unsupported and easily deflect to create a bed for tiles 1 while accommodating uneven structural surfaces and pedestrian traffic forces.

Figure 9C:
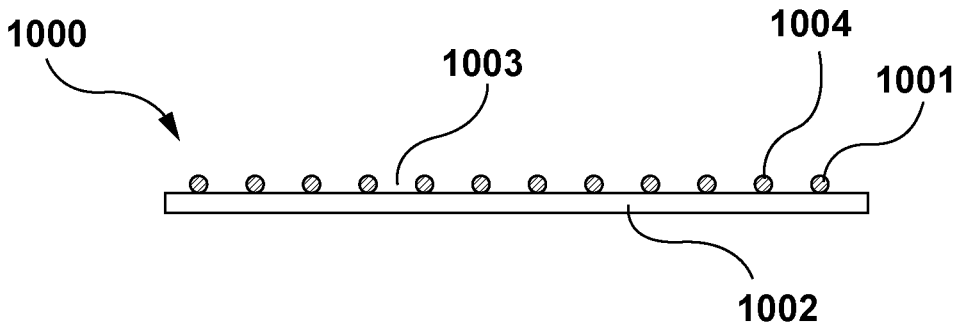
FIGS. 9C and 9D are side and top views, respectively, of another embodiment of a drainage/conformity layer.
Figure 9D:
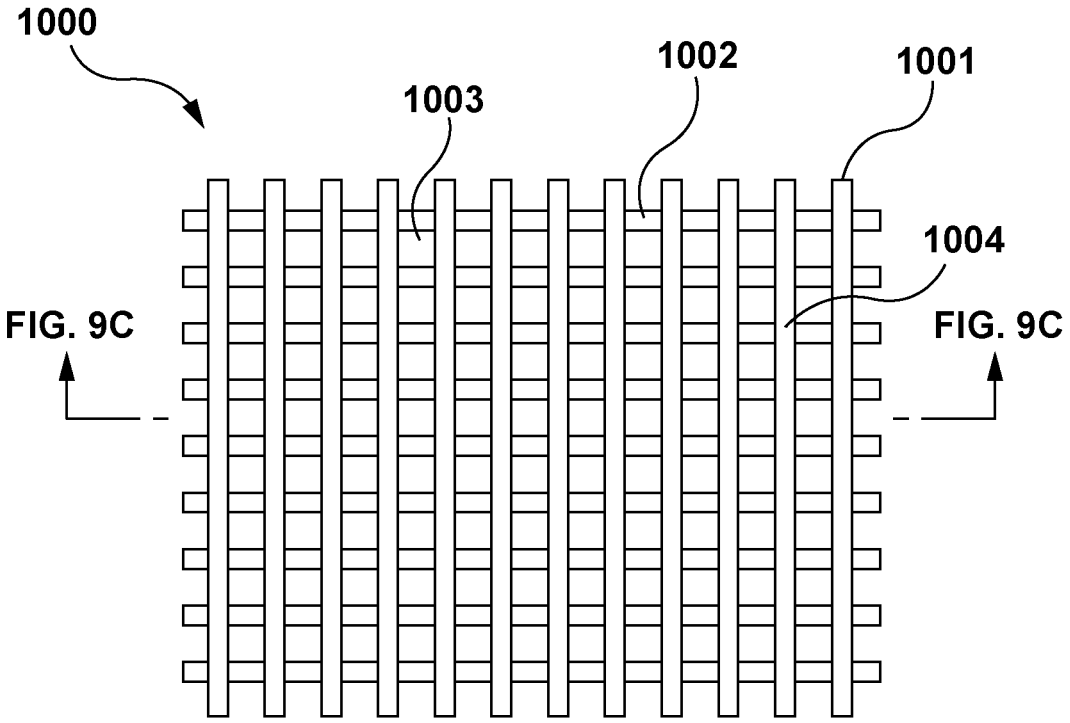

FIGS. 9C and 9D show side and top views, respectively, of another embodiment of a drainage/conformity layer 1000 in which drainage/conformity layer 1000 is constructed of elastomeric rods in the form of a top layer 1001 and a bottom layer 1002. The elastomeric rods in each layer 1001, 1002 can have any shape and are shown as being round. Individual rods forming top layer 1001 are connected with individual rods forming bottom layer 1002 at connection points 1004 to form drainage holes 1003 therebetween. As shown, each of the individual rods of top layer 1001 can be arranged to be parallel with each of the other individual rods of top layer 1001 and each of the individual rods of bottom layer 1002 can be arranged to be parallel with each of the other individual rods of bottom layer 1002. Each of the individual rods of top layer 1001 can be perpendicular to each of the individual rods of bottom layer 1002 (as shown) or each of the individual rods of top layer 1001 can be arranged at any other practical angle relative to each of the individual rods of bottom layer 1002. The rods of the top layer 1001 and the bottom layer 1002 can be the same durometer or can be different durometers so that in combination they may work as a variable rate cushion or spring (as described above). In some embodiments, the drainage/conformity layer 1000 should be installed so that drainage off an underlying structure is in a direction that is parallel to the direction of the individual rods of the bottom layer 1002.

Figure 9E:
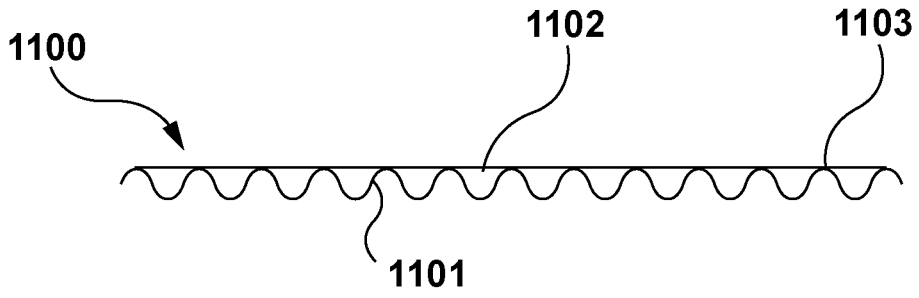
FIGS. 9E and 9F are side and top views, respectively, of another embodiment of a drainage/conformity layer.
Figure 9F:
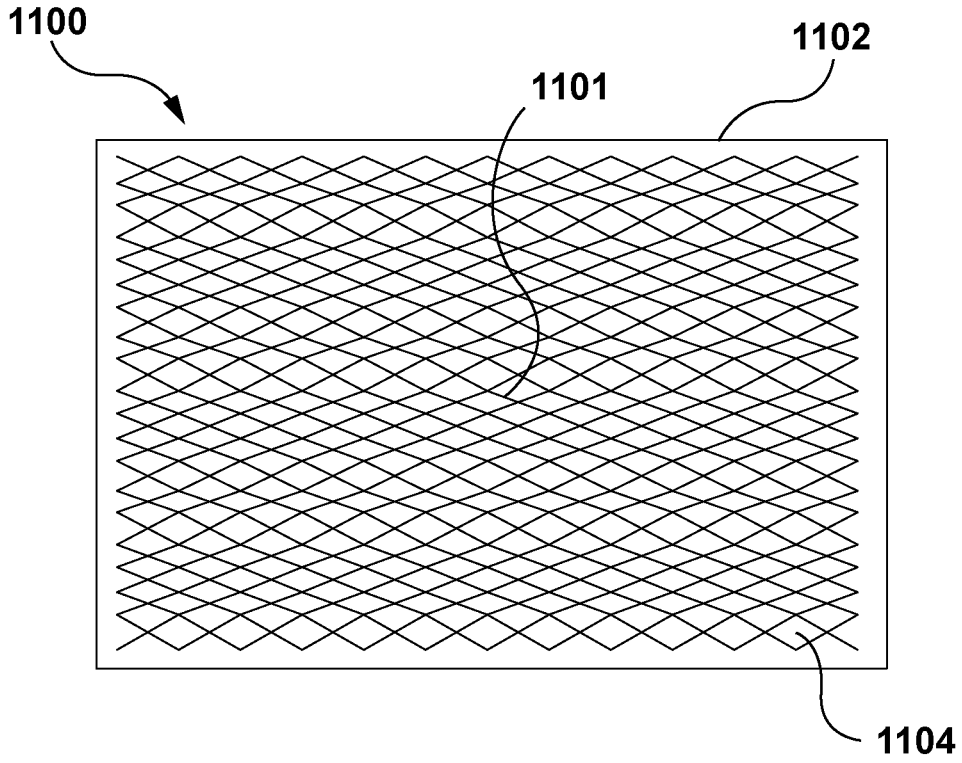

FIGS. 9E and 9F show side and top views, respectively, of another embodiment of a conformity/drainage layer 1100 in which conformity/drainage layer 1100 is constructed of a rigid corrugated screen 1101 made from plastic or metal. To stiffen the corrugations, a strong top sheet 1102 may be connected at the apex of the corrugations 1103. Top sheet 1102 is made from a free draining material such a landscape cloth, screening or the like. Water is free to pass through the top sheet 1102 and through openings 1104 in corrugated screen 1101. The conformity/drainage layer 1100 provides significant support in a wide area and is also easily deformable in localized area to alleviate pressure points.

Referring now to FIGS. 10A to 10F, although reference will be made to flexible support screen 2, it should be noted that the flexible support screen 2 may be a composite of a bedding layer 2*a* and conformity/drainage layer 2*b* as discussed herein and that the functional aspects may be common to all the potential flexible support screens embodiments described herein.

Flexible support screen 2 may be secured to an underlying structure by means of fasteners that may include ordinary staples or other suitable fasteners. Alternatively, flexible support screen 2 may be unsecured. Tiles 1 are laid over a top surface of the flexible support screen 2 and may be held in place by virtue of the weight of tiles 1 and the close abutting relationship between adjacent tiles 1.

FIG. 10A through 10F describe some features of support screen 2.

Figure 10A:
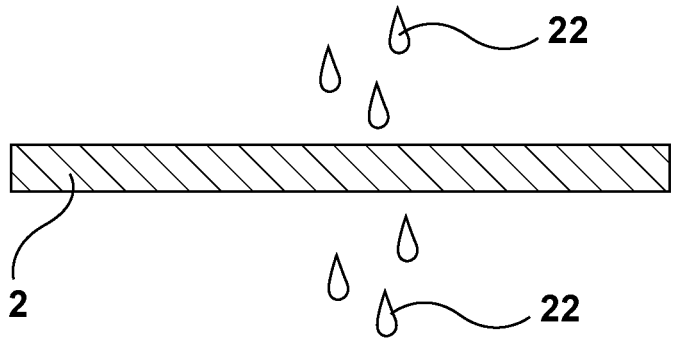
FIG. 10A is a side view of a flexible support screen embodiment showing a functional aspect thereof.

FIG. 10A shows that support screen 2 is pervious to water when bedding layer 2*a* is pervious to water as described in FIGS. 4C and 4D. Water droplets 22 pass through support screen 2 relatively uninterrupted.

Figure 10B:
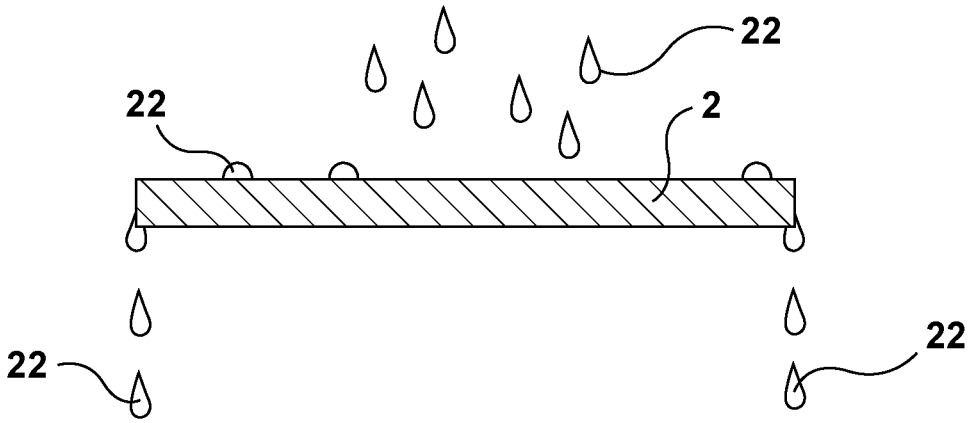
FIG. 10B is a side view of another flexible support screen embodiment showing a functional aspect thereof.

FIG. 10B shows that support screen 2 is impervious to water when bedding layer 2*a* is impervious to water as described in FIGS. 4A and 4B. Water droplets 22 ride on the top of support screen 2 and drip off the edges of support screen 22.

Figure 10C:
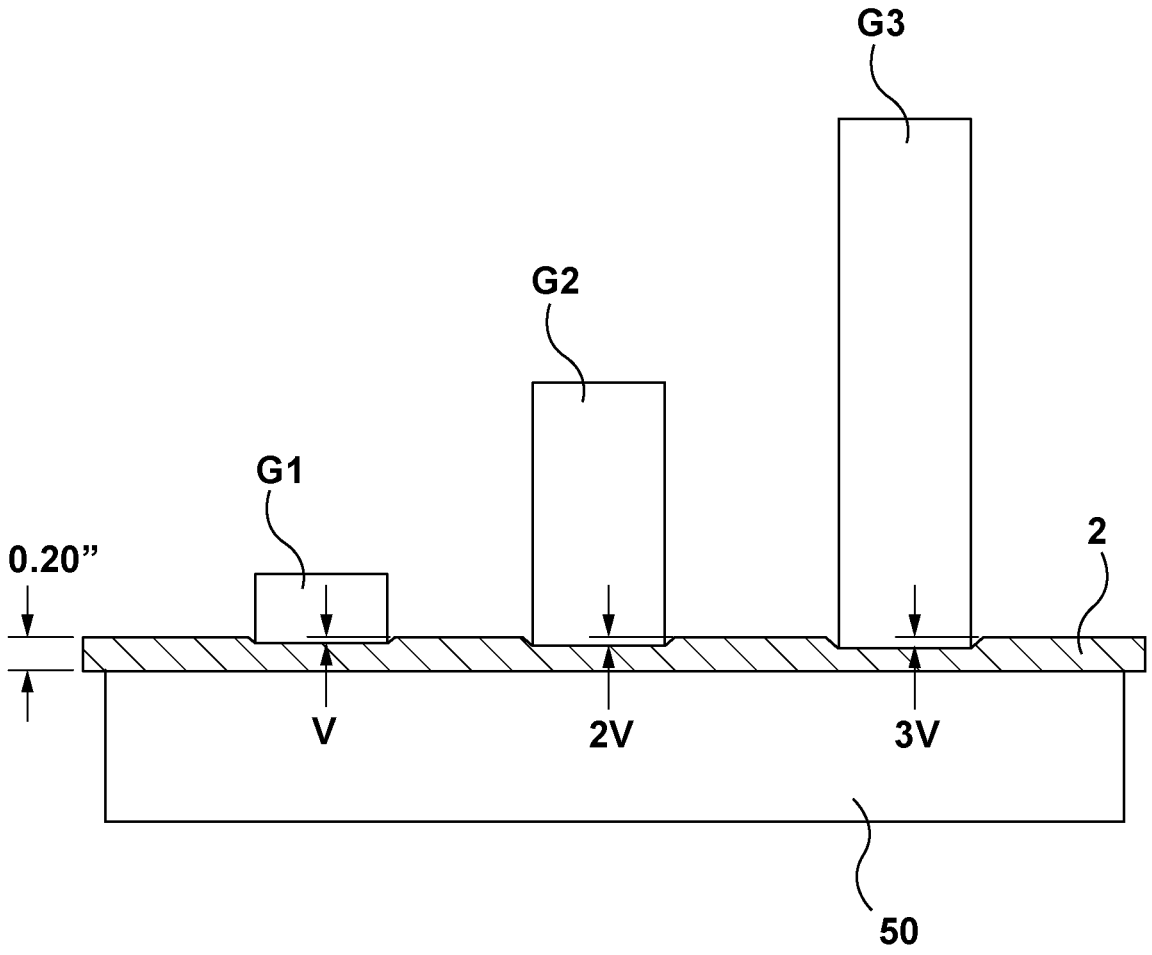
FIG. 10C is a side view of a flexible support screen according to one embodiment with three loads thereon showing a functional aspect of the flexible support screen.

FIG. 10C represents schematically the desirable progressive (i.e. variable) rate response of the flexible support screen 2 to loads directed downwardly on it by tiles placed thereon. G1 represents the 0.07 psi pressure resulting from the approximate load of the tiles alone. G2 represents 7 psi pressure resulting from a 100 lb person totally supported by a 1 ft2 tile. G3 represents 21 psi pressure resulting from a 300 lb person totally supported by a 1 ft2 tile. The deflections resulting from G1, G2 and G3 are respectively V, 2V and 3V, demonstrating such a progressive rate response. The low initial rate allows compliance to small vertical irregularities of the support structure and the progressive rate inhibits excessive deflection from live loading by people.

Flexible support screen 2 may be secured to their underlying structure by means of fasteners that may include ordinary staples or other suitable fasteners or it can be left to float with no fastening mechanism. Tiles 1 are laid over top of the flexible support screen 2 and held in place by virtue of the weight of tiles 1 and the close abutting relationship between adjacent tiles 1.

In some embodiments, as noted above, flexible support screen 2 may have a thickness in a range of about 0.188 inches and 0.500 inches. It should be noted that as the thickness of flexible support screen 2 increases, it may be easier to achieve some of the functional requirements noted herein (e.g. directing water and deflecting loads), however, thin screens are desired in instances where there are thickness restrictions for the tile floor system.

Figure 10D:
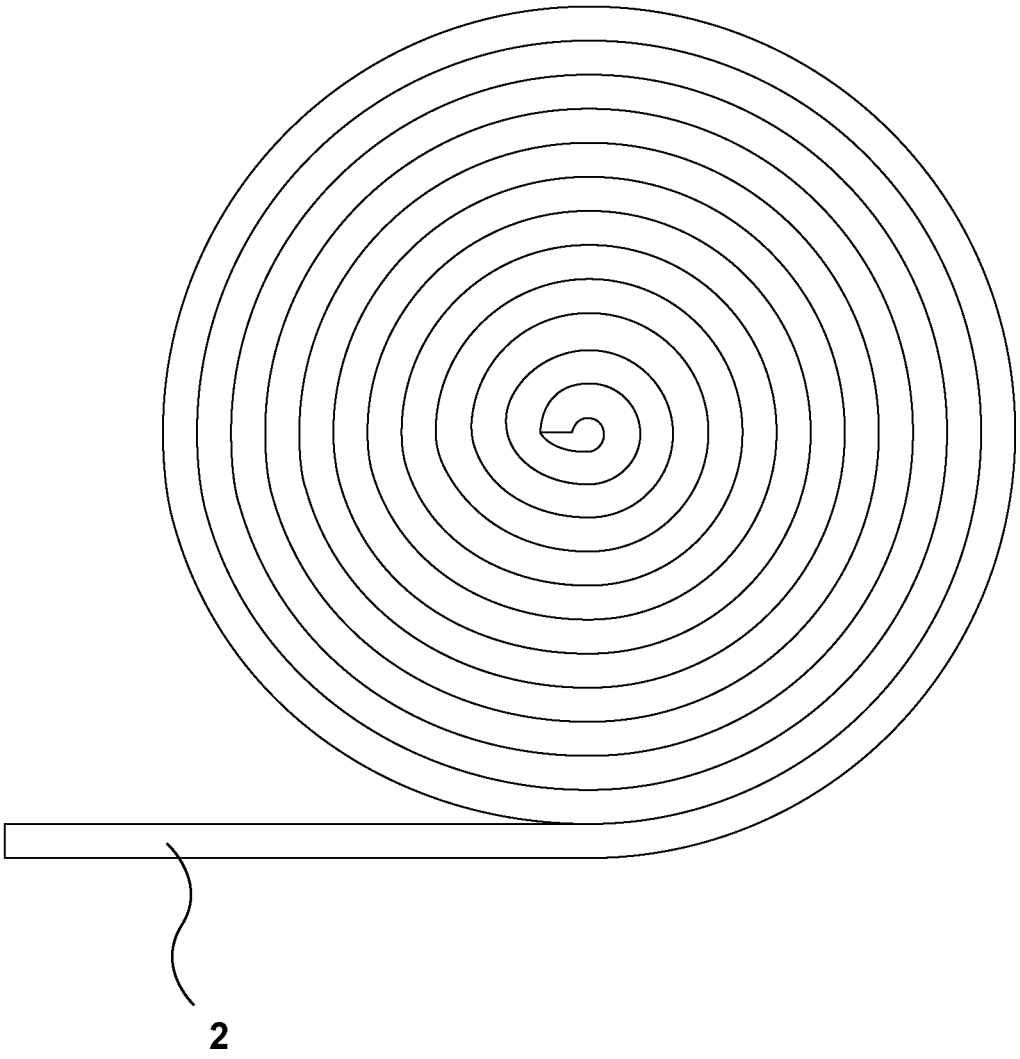
FIG. 10D is a side view of a flexible support screen according to one embodiment rolled-up around a small cylindrical tube.

As shown in FIG. 10D, flexible support screen 2 is made of a material that is sufficiently elastic to provide for the flexible support screen 2 to be rolled up into large rolls for easy transportation (e.g. about 3-6 feet wide) without the flexible support screen 2 cracking, creasing or breaking.

Figure 10E:
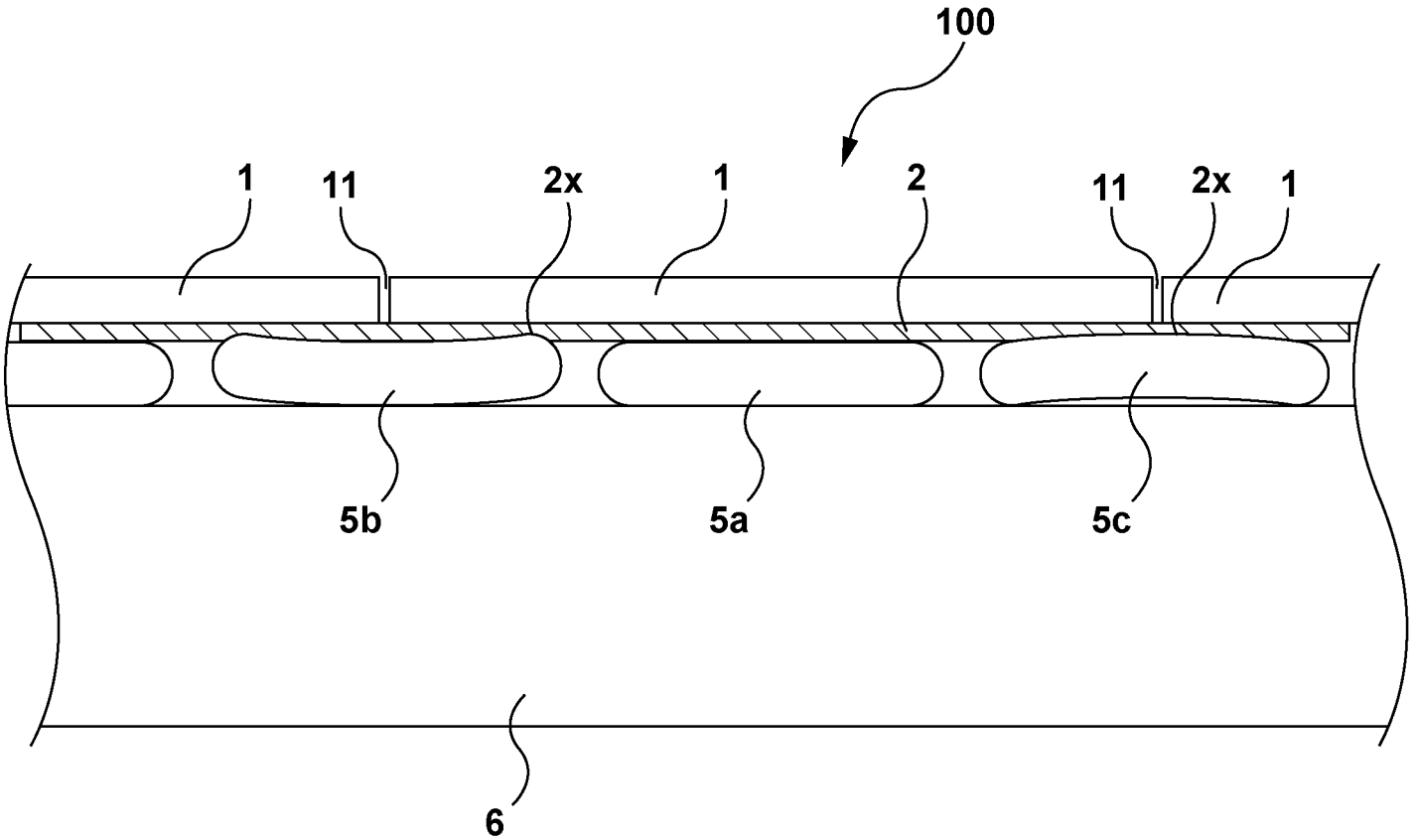
FIG. 10E is side view of a flexible support screen according to one embodiment laid on an uneven wooden support structure supporting heavy floating tiles.

As shown in FIG. 10E, flexible support screen 2 is also sufficiently elastic to conform under the weight of the floating tiles 1 to accommodate an uneven structural base 6 to create a flat top surface on which to install the floating tiles 1. In this manner, flexible support screen 2 may function analogously to un-set tile adhesive (e.g. mortar or mud) or bedding sand. Specifically, FIG. 10E shows a flat pressure treated deck board 5*a* connected to a wooden floor joist 6, an upwardly cupped pressure treated deck board 5*b* connected to a wooden floor joist 6 and a downwardly cupped pressure treated deck board 5*c* connected to a wooden floor joist 6. Flexible support screen 2 is sufficiently elastic to conform under the weight of the floating tiles 1 to accommodate an uneven structural base 6 created by flat pressure treated deck board 5*a*, upwardly cupped pressure treated deck board 5*b* and downwardly cupped pressure treated deck board 5*c* to create a relatively planar top surface on which to lay the floating tiles 1.

FIG. 10E shows one unique situation using the full capability of the support screen 2 to comply with vertical irregularities of the support system. A first deck board 5*a* is shown with a substantially flat cross-section. A second deck board 5*b* is shown with a localized upward cup of about 0.060 inch maximum extent. A third deck board 5*c* is shown with a localized downward cup of about 0.060 inch maximum extent. The situation creating a high point on the wooden or concrete structural base can be varied (cupping, warping, cracking, heaving etc.). It is desirable to choose a support screen material and configuration to result in an initial compressive spring rate permitting the depicted deflection under the static loading of the supported tiles. It is important to note that the contemplated high points are limited to a small localized areas. By way of example 0.25" thick support screen might conform, under the static weight of the supported tiles, to a maximum 0.060 inch upward or downward cupping of the underlying support decking in a small localized area. If a localized high point exceeds 0.060 inch, or if the high point affects a larger area, then the flexible support screen 2 can simply be cut away to alleviate pressure as shown in FIG. 3B. Field tiles 1 are strong enough to span the gaps resulting from such trimming and therefore the system is able to absorb localized high points extending up to the thickness of the support screen 2.

Figure 10F:
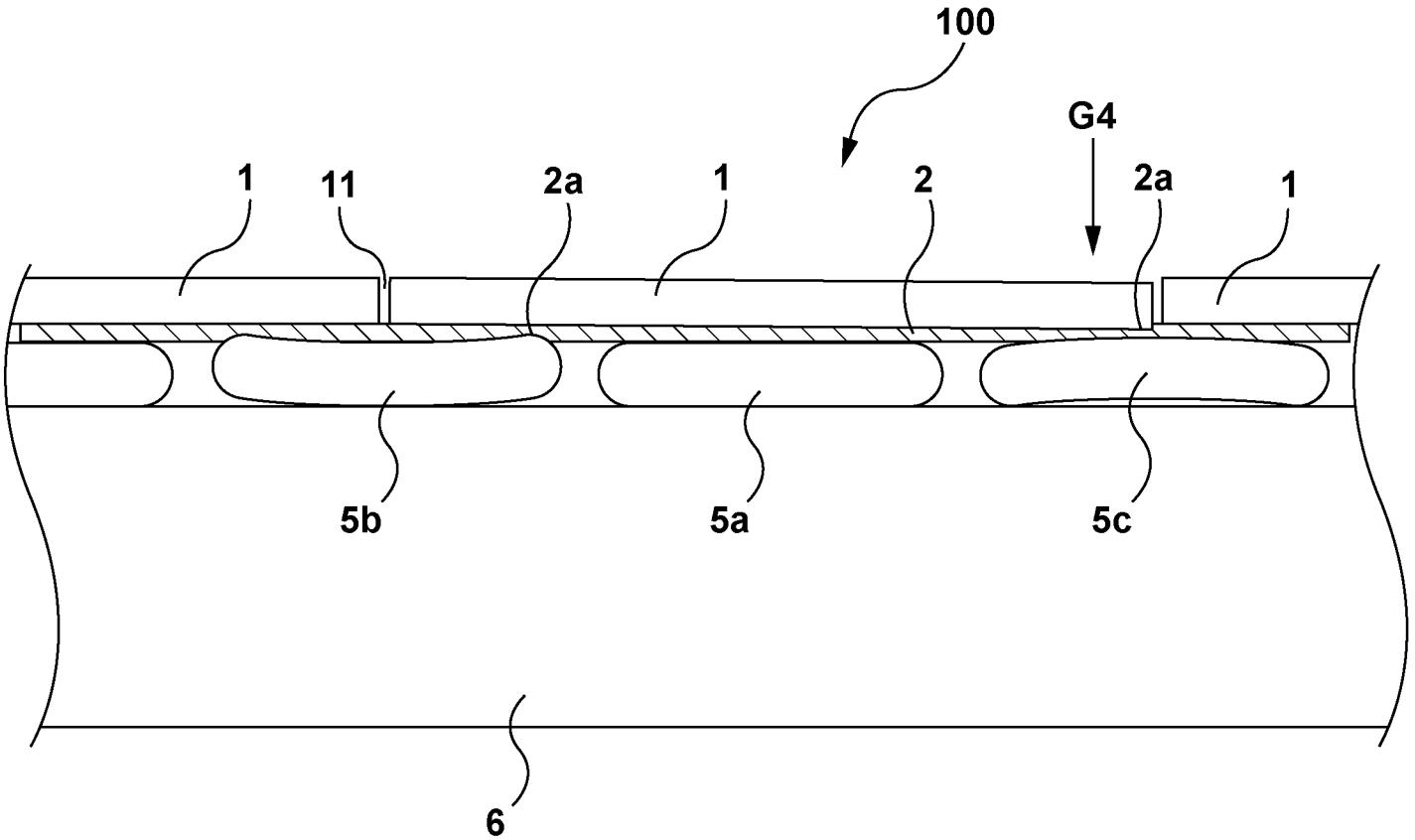
FIG. 10F is side view of a flexible support screen according to one embodiment laid on an uneven wooden support structure supporting heavy floating tiles showing a pedestrian load near an edge of one of the heavy floating tiles.

FIG. 10F shows how the flexible support screen 2 may work as a variable rate spring and deflect slightly under the increased and variable load G4 of pedestrian traffic. The floating tiles 1 may move downwardly and then back to a neutral position when the variable load G4 of pedestrian traffic is applied and removed, however, the total movement of the tiles 1 is minimal because the flexible support screen 2 becomes increasingly rigid as the load G4 is applied. Support screen 2 works such that the movement of tile 1 is small enough that it is not perceptible to the average person walking on the surface of the tiles 1.

The systems described herein may further include one or more tile spacers positioned between one or more adjacent tiles to separate adjacent tiles and to inhibit movement (e.g. vertical and/or lateral movement) of the one or more adjacent tiles after being installed and during use.

The tiles spacers described herein are generally for use in systems such as those described herein and are generally retained indefinitely between tiles after installation. This is in contrast to conventional tile spacers that are used primarily to provide consistent spacing between adjacent tiles after tiles are placed on a wet tile adhesive layer and are subsequently removed from the spacing between the tiles after the wet tile adhesive layer has set and before the grout is installed. In this fashion, the tile adhesive layer beneath the tiles inhibits movement of the tiles after the tiles are installed and before the grout has been installed.

Figure 11A:
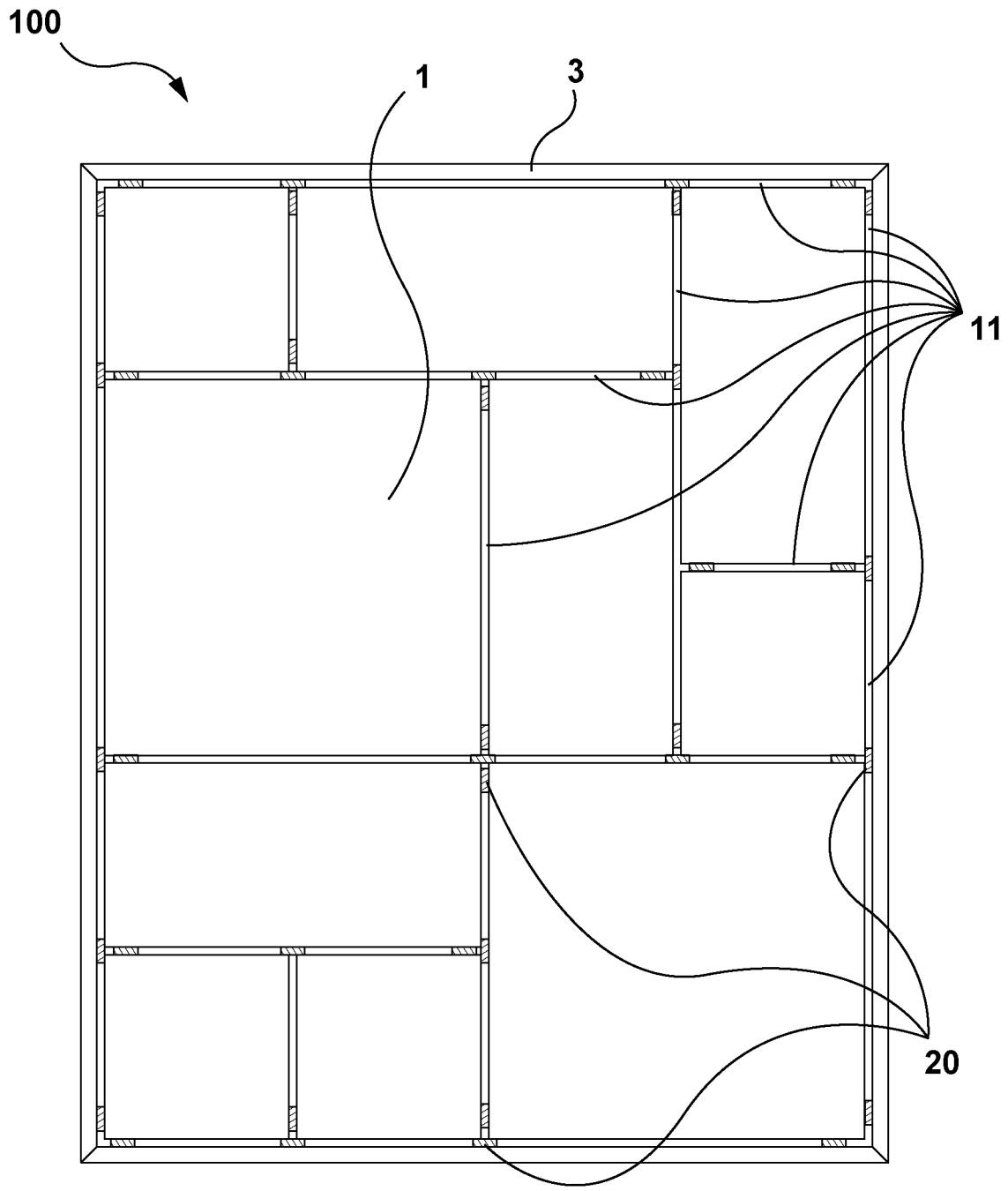
FIG. 11A is a plan view of a tile floor system covering a wooden deck showing rigid spacers separating the floating tiles, in accordance with one embodiment.

FIG. 11A shows system 100, being a pressure treated deck covered with tiles 1 retained by skirting 2. Tiles 1 are floating on support screen 2 which is supported by pressure treated deck boards that are connected to a pressure treated deck frame. The tiles are separated by gaps 11. The gaps have been established by spacer 20 of FIGS. 11B and 11C.

Figure 11B:
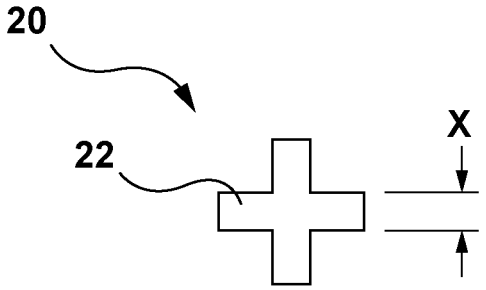
FIGS. 11B and 11C are top and side views, respectively, of one embodiment of a tile separator.
Figure 11C:
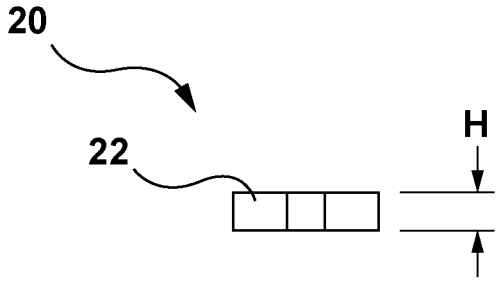

FIGS. 11B and 11C show a top view and a front view, respectively, of a conventional tile spacer 20 of a conventional tile and grout systems. Conventional Spacers 20 are generally made of hard plastic materials. Spacers 20 may be placed between adjacent tiles such that spacer legs 22 establish a gap 11 between adjacent tiles 1 along their respective edges 102. In some embodiments, tile spacer 20 has a thickness X and the spacer leg 22 has a height H that may be lower than a thickness of the tiles 1. In conventional adhesive/grout applications, spacers 20 are removed before grouting. Conventional tile spacers 20 will not work well in the systems described herein as they are shaped to be removed from existing tile systems prior to grouting. Further, conventional tile spacers 20 are generally made of hard (e.g. non-compressible) plastic materials that will not work well in the systems described herein (no matter what the shape) as the slight but constant vertical movement of floating tiles 1 sitting on a flexible base will push conventional tile spacers 20 or any other hard spacer out of gap 11.

FIGS. 11B, 11C, 11D and 11E represent embodiments that work well in the system herein as defined.

Figure 11D:
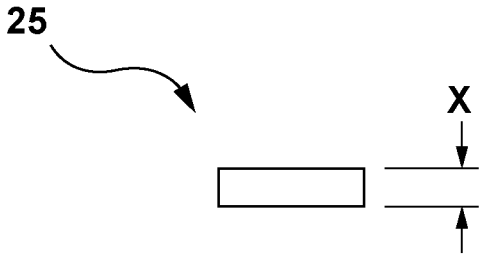
FIGS. 11D and 11E are top and side views, respectively, of one embodiment of a tile separator spring.
Figure 11E:
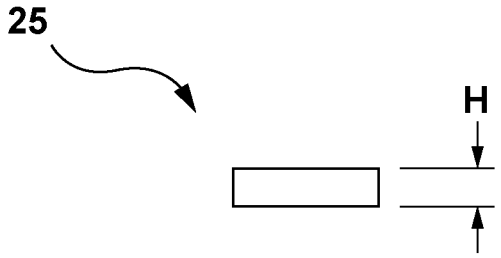

FIGS. 11D and 11E show a top view and a front view, respectively, of another embodiment of a tile spacer 25. Tile spacer 25 is a much simpler shape than spacer 20. Spacer 25 is flexible and compressible and generally unaffected by (e.g. does not easily degrade in response to) seasonal temperature changes. In some embodiments, spacer 25 may be made of a similar material as some or all the flexible support screen 2. Spacer 25 has a thickness X that establishes a width of the gap (e.g. gap 11) between tiles. In some embodiments, thickness X of spacer 25 is often about 1/32" to about 3/32", although it can be up to about 3/8" wide or in some applications more than 2 inches wide. Spacer 25 has a height H that may be about 1/2 the height of the tiles 1, in some examples. The flexibility of spacer 25 allows tighter and looser installations which require less than perfection in the squareness and dimensions of the tiles. As a result, the system can easily employ standard industry tile cutting tolerances.

Figure 11F:
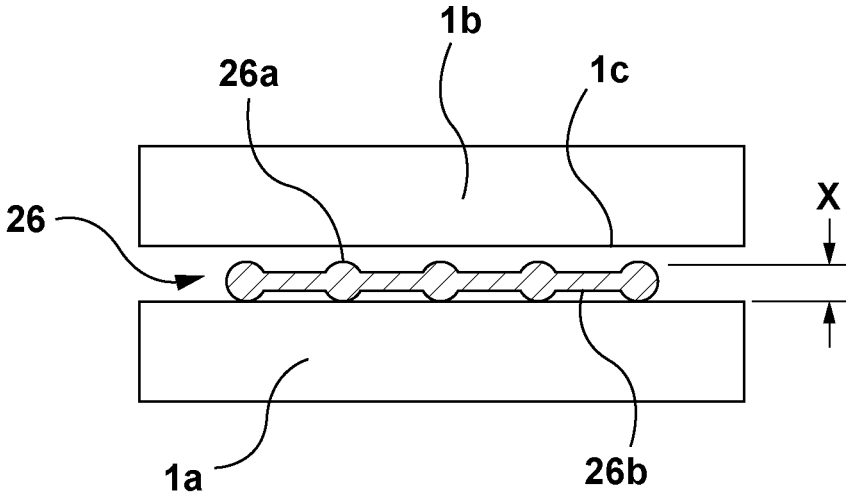
FIGS. 11F and 11G are top and side views, respectively, of another embodiment of a tile separator spring.
Figure 11G:
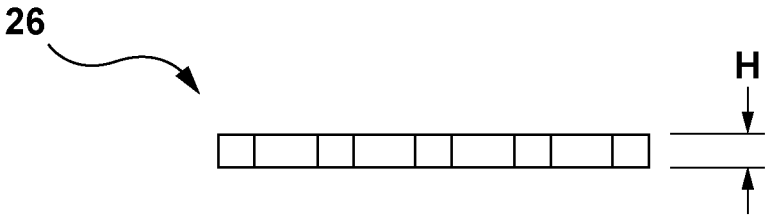

FIGS. 11F and 11G show top and front views of a spacer 26 that is also flexible and compressible. Again, spacer 26 is impervious to seasonal temperature changes and may be made of a similar material as the flexible support screens described herein. Spacer 26 has a thickness X that establishes the gap (e.g. gap 11) between tiles. Spacer 26 also includes ribbing that may act as a variable rate spring when compressed by tile face 1*c* of tile 1*b* when the gap 11 is closed between tile 1*a* and tile 1*b*. Ribbing refers to tile spacer 26 having portions 26*a* that are thicker than portions 26*b* of the spacer 26. Ribbing of spacer 26 provides for spacer 26 to have a variable resistance to compression during compression. For example, during compression, portions 26*a* initially compress. When portions 26*a* are compressed to a thickness equal to the thickness of portions 26*b*, the resistance of the spacer 26 to compression increases dramatically. Again, spacer 26 may have a height that is less than a height of the tiles 1*a*.

To further enhance the performance of spacers 25 and spacer 26 and to overcome the problem of spacers working out of gap 11, spacer 25 and spacer 26 may include an adhesive (e.g. VHB™ adhesive, an acrylic adhesive, an epoxy-based adhesive, or the like) on one or more faces of the spacer 25 or 26 that determine gap 11 between tiles 1. The adhesive, when positioned on opposed faces of spacer 25 or spacer 26, serves to physically connect adjacent tiles 1. Any adhesive that is impervious (i.e. resistant) to weather conditions and temperature fluctuations of seasonal changes may be used. Further, the adhesive may be factory applied to the spacers or may be applied by a user (e.g. during installation). In one specific embodiment, the adhesive may be applied to one or more faces of the spacer and be protected prior to and during assembly by one or more removable tabs. Also, the adhesive could be formed as a puck that can be dispensed by a dispensing tool directly onto an edge of tiles of the system 100. As in the case of conformance/drainage layer 2*b*, there are many potential embodiments of spacers that can be included in system 100

In some embodiments of the system 100, an adhesive may be used to connect adjacent tiles together without the use of a tile spacer such as spacer 25 or spacer 26.

Figure 11H:
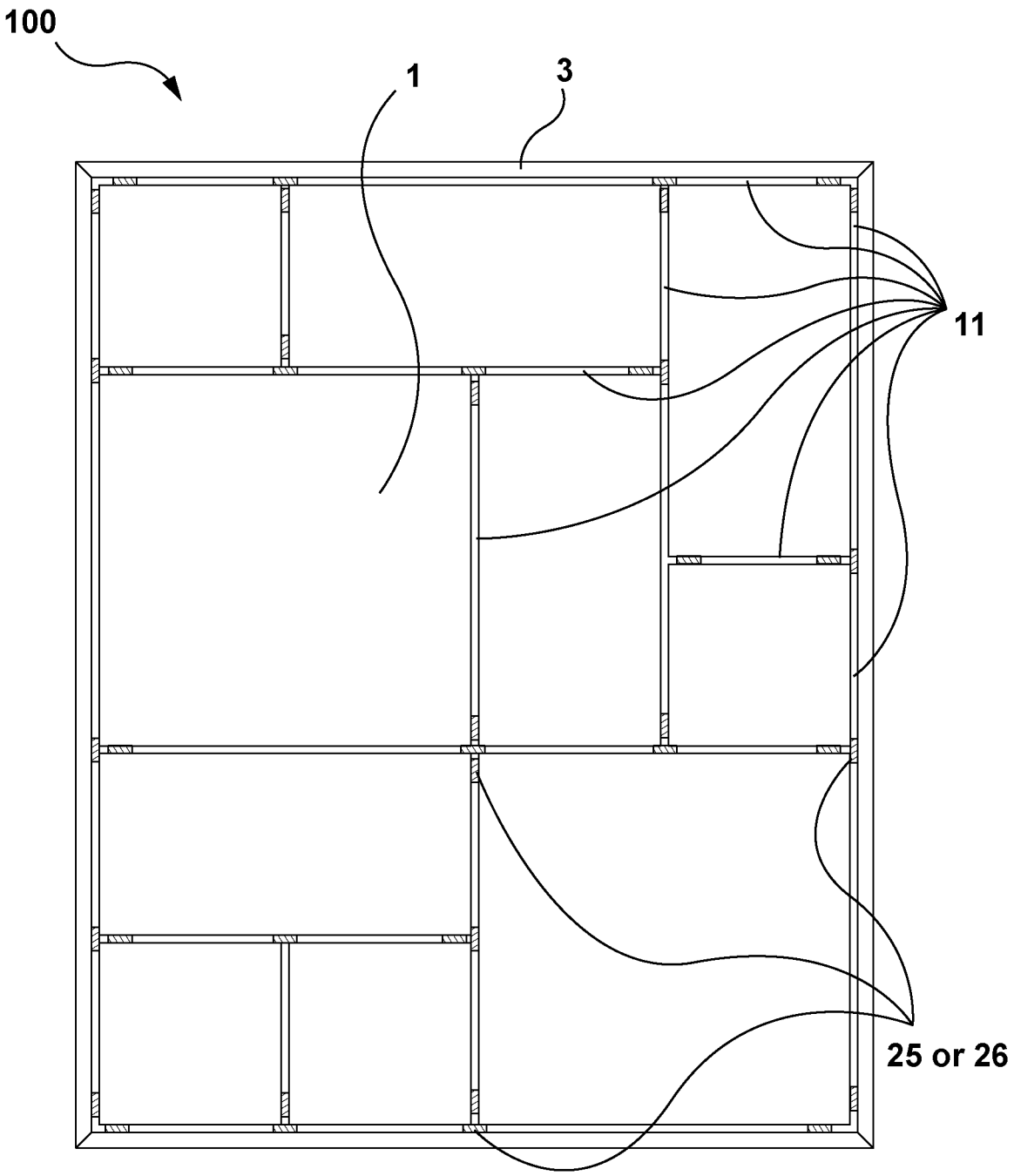
FIG. 11H is a top view of another embodiment of a tile floor system showing floating tiles laid on a support structure and retained thereon by an edge band and with the floating tiles being separated by adhesive tile separator springs.

FIG. 11H shows a top view of a floor construction (e.g. floor assembly 100 of FIG. 1A). During system 100 assembly, a flexible support screen as described herein is placed on top of the support structure and tiles 1 are arranged on top of said flexible support screen. As tiles 1 are installed, tile spacers 25 or spacers 26 having adhesive are placed between tiles 1 to form the required gap 11 between the tiles. During assembly, an installer installs at least one spacer 25 or one spacer 26 on each side of each tile and uses a block to tap the tile 1 into position. Ashlar patterns (as shown) are notoriously difficult because of the very accurate tile cutting required. Spacer 25 and spacer 26 provide the system with dimensional and physical flexibility for quick and efficient installation.

Figure 11I:
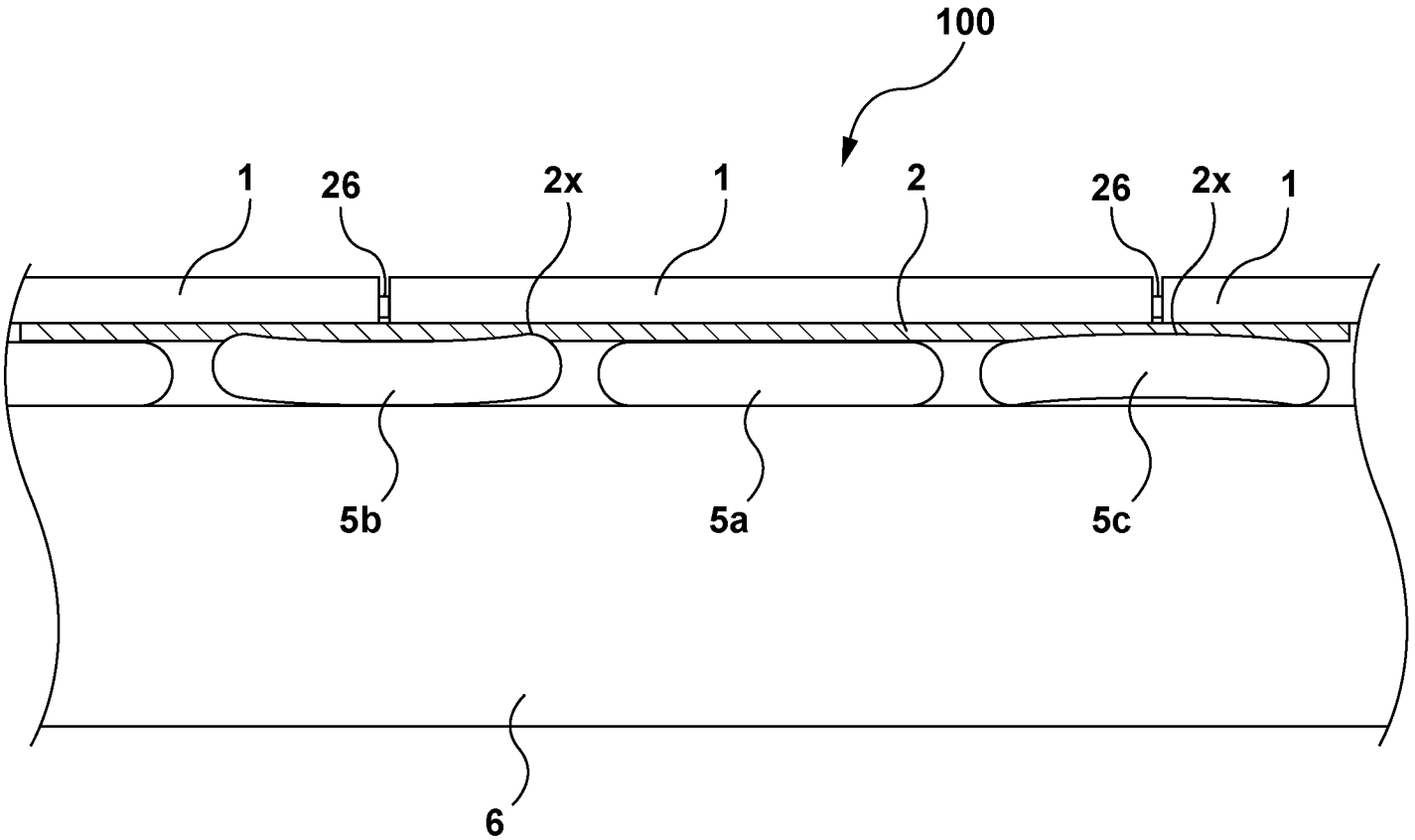
FIG. 11I is a cross sectional view of another embodiment of a tile floor system showing floating tiles laid on a support structure and with the floating tiles separated by adhesive tile separator springs.

FIG. 11I is a side view of system 100 with spacers 26 installed with adhesive. Support screen is able to deflect slightly under the increased and variable load G4 of pedestrian traffic. Spacers 26 with adhesive on one mounting face will remain in gap 11 as floating tiles 1 move up/down during service. Spacers 26 with adhesive on both mounting faces will also stay in gap 11, and as an added benefit will work to absorb force G4 and spread it onto adjacent tiles 1, and in turn minimizing the up/down movement of said tiles 1. In this way the entire field of tiles 1 becomes a flexible lattice network and significantly more rigid than floating tiles alone. The presence of tile spacers such as spacers 26 may provide for bending flexure between adjacent tiles rather than vertical slippage between tiles. As such, the spacers 26 act in shear to cause adjacent tiles to share in resisting loads G4. This shear force transmission results in an effective hinge action at tile joints which inhibits perceptible tile to tile height differences across gaps. The systems described herein are flexible enough to deal with minor movement within the structure, yet rigid enough to perform well in the intended application.

Figure 11J:
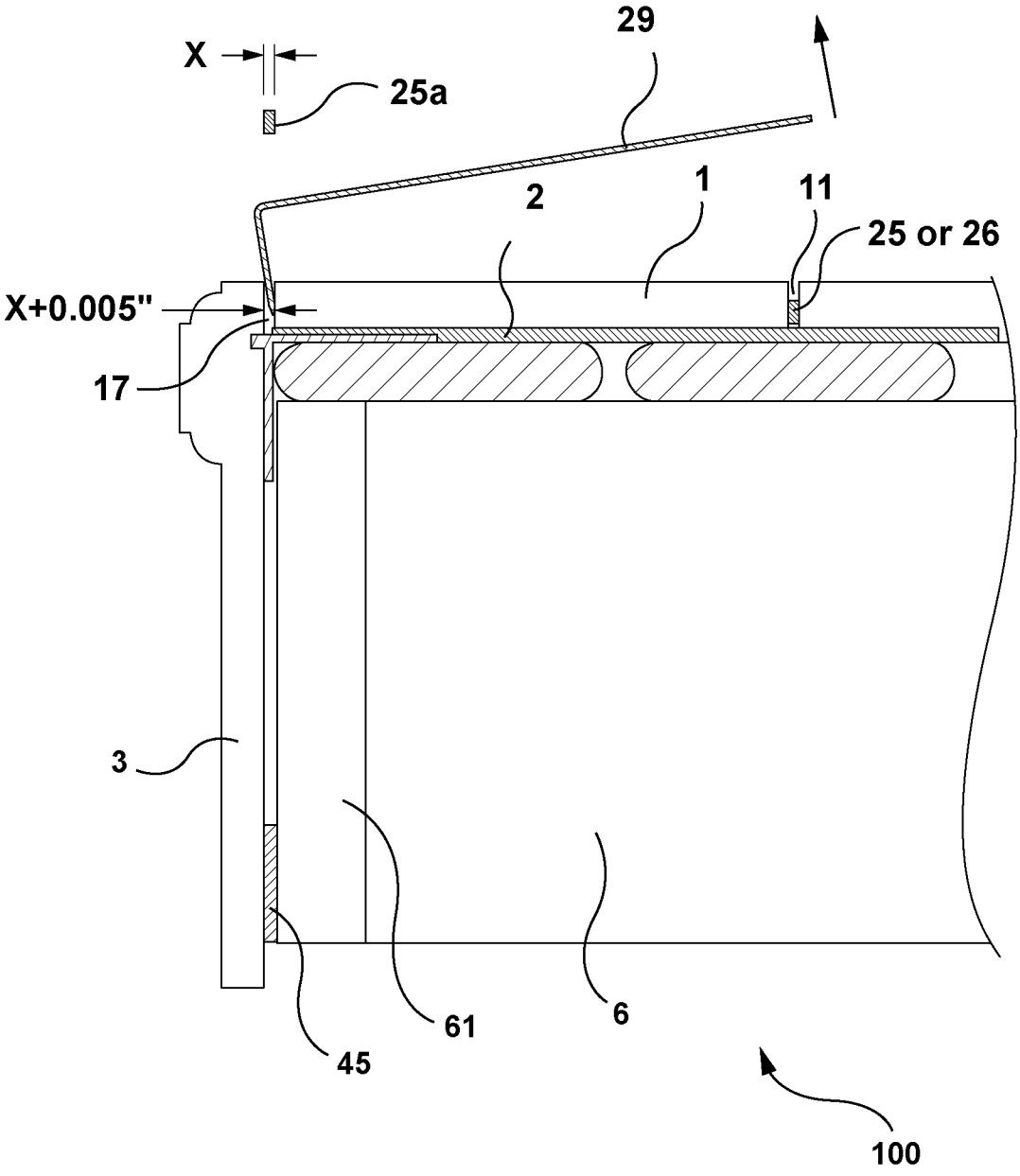
FIG. 11J shows a cross-sectional view of the tile floor system of FIG. 11H showing a step in a process for installing a final tile separator spring.

FIG. 11J shows a side profile view of a floor construction 100 with a simple pry bar 29 being employed to install the final spacers 25*a* positioned at an edge of the system 100. Final spacers 25*a* of the system 100 may not be coated with adhesive and may be installed in various thicknesses and at various locations dependent on the needs of the specific installation. Generally final spacers 25*a* will be installed near an edge of the systems described herein in low traffic areas, however, final spacers 25*a* may also be installed at other positions within the system. During assembly, the tiles 1 positioned at the edge of the system 100 may be cut to size in order to fit properly. Usually the tiles positioned at an edge of the system 100 should be cut at a dimension so that edge gap 17 is similar to (but slightly smaller than) gaps 11 in the rest of the installation. In this installation, tool 29 is used to gently pry open the edge gap 17 between tile 1 and coping tile 3 by compressing spacers 25 or spacers 26 in adjacent gap 11, to create an edge gap 17 having a width that is a little bit larger than dimension x of spacer 25*a* in order to comfortably slide spacer 25*a* into edge gap 17 between the tile 1 and coping tile 3. As a final step, the simple pry bar 29 is removed, the tile 1 slides towards the coping tile 3 and the flexible and compressible spacers 25*a* become the final key in locking the tile field together. It will be understood that the pry bar depicted is merely explanatory of the general direction and size of assembly force used and could be provided by a similar tool especially adapted for the purpose.

Figure 12A:
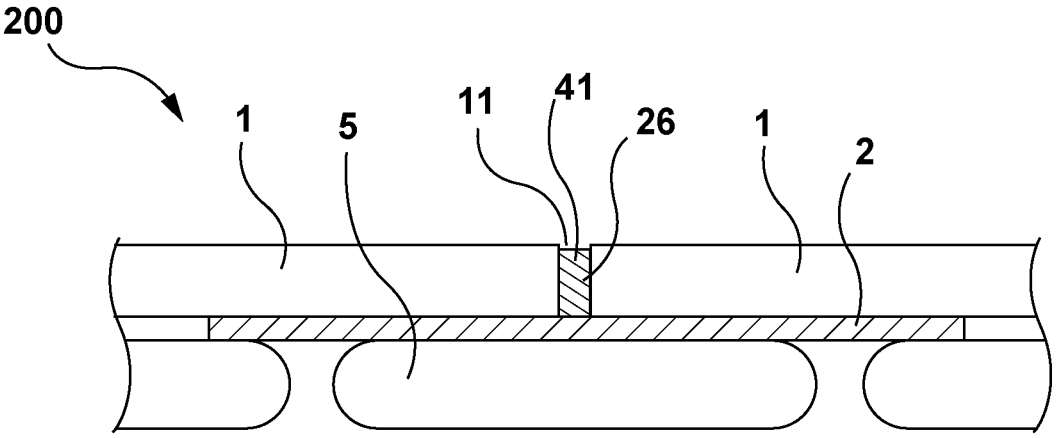
FIG. 12A is a side profile view of another embodiment of a tile floor system showing floating tiles on top of a flexible support screen with tile spacers and polymeric sand in gaps between adjacent tiles.
Figure 12B:
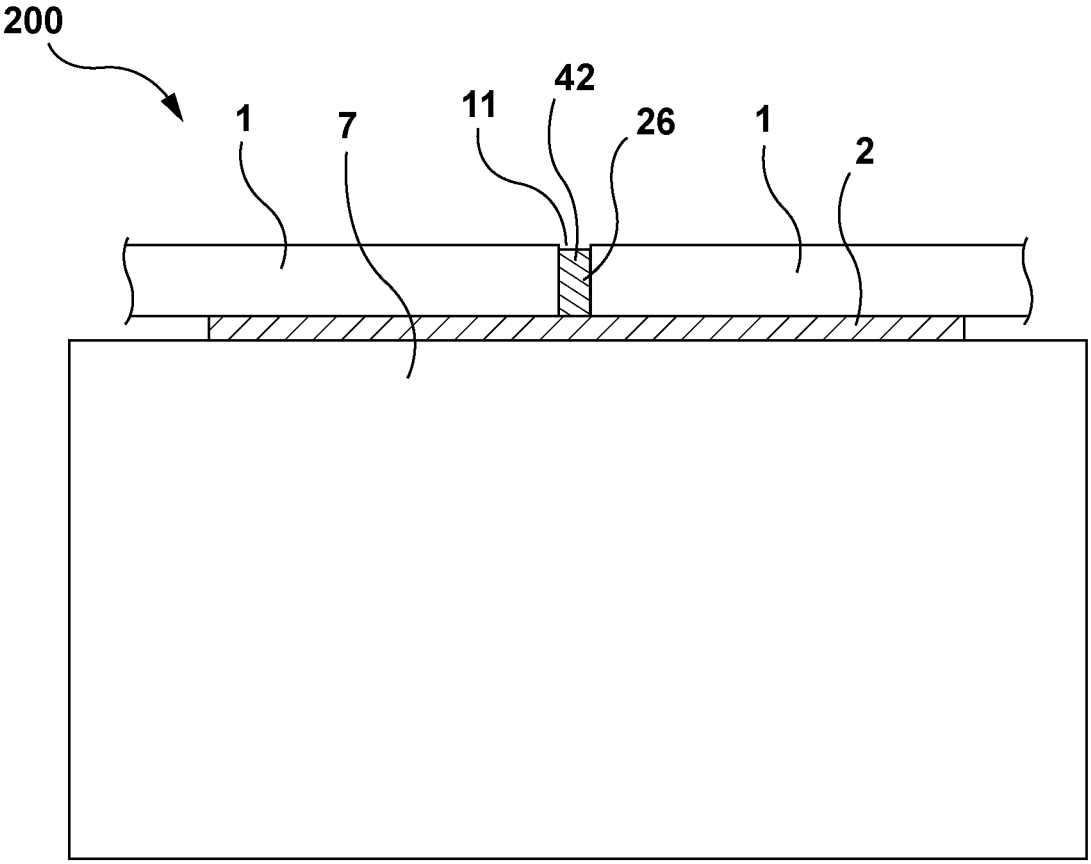
FIG. 12B is a side profile view of another embodiment of a tile floor system showing floating tiles on top of a flexible support screen with tile spacers and flexible in gaps between adjacent tiles.
Figure 12C:
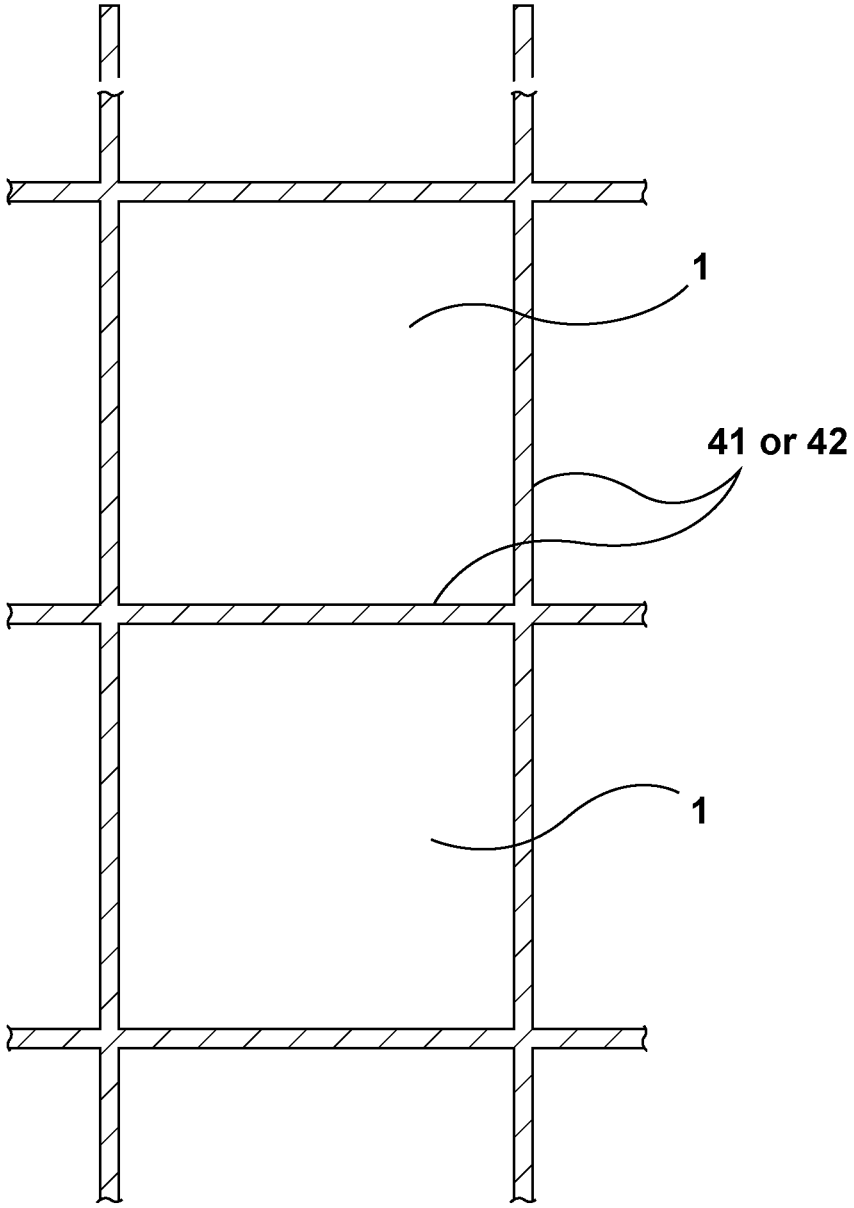
FIG. 12C is a top view of the system described herein showing polymeric sand or flexible grout in a gaps between adjacent tiles.

FIG. 12A through 12C depict polymeric sand 41 or flexible grout 42 installed in gaps 11. In some installations and particularly as gap 11 increases in width, installers of the system described herein may wish to fill the gaps 11 for a more conventional tile floor installation appearance. A width of gap 11 is defined by a tile spacer 25 or spacer 26 positioned in the gap 11 between adjacent tiles 1. Tile spacer 25 or spacer 26 abuts a side portion of each of the tiles 1 and is resilient to inhibit horizontal movement of the tiles 1 towards and away from each other. Flexible support screen 2 is below tiles 1, above the structure and extending across and beneath the gap 11. Polymeric sand 41 and flexible grout 42 can be installed directly on top of support screen 2 and spacers 25 or spacers 26 without negative consequence to the system described herein. Unlike conventional tile floor installations, in the system described herein, grouting can be installed immediately after field tiles 1 are in place and without waiting overnight for conventional tile adhesive to set.

FIG. 12A is a cross sectional view that depicts system 100 with polymeric sand 41 installed in gaps 11.

FIG. 12B is a cross sectional view that depicts system 200 or system 300 with flexible grout 42 installed in gaps 11.

FIG. 12C is a top view of the systems described herein with polymeric sand 41 or flexible grout 42 in gaps 11.

Figure 13A:
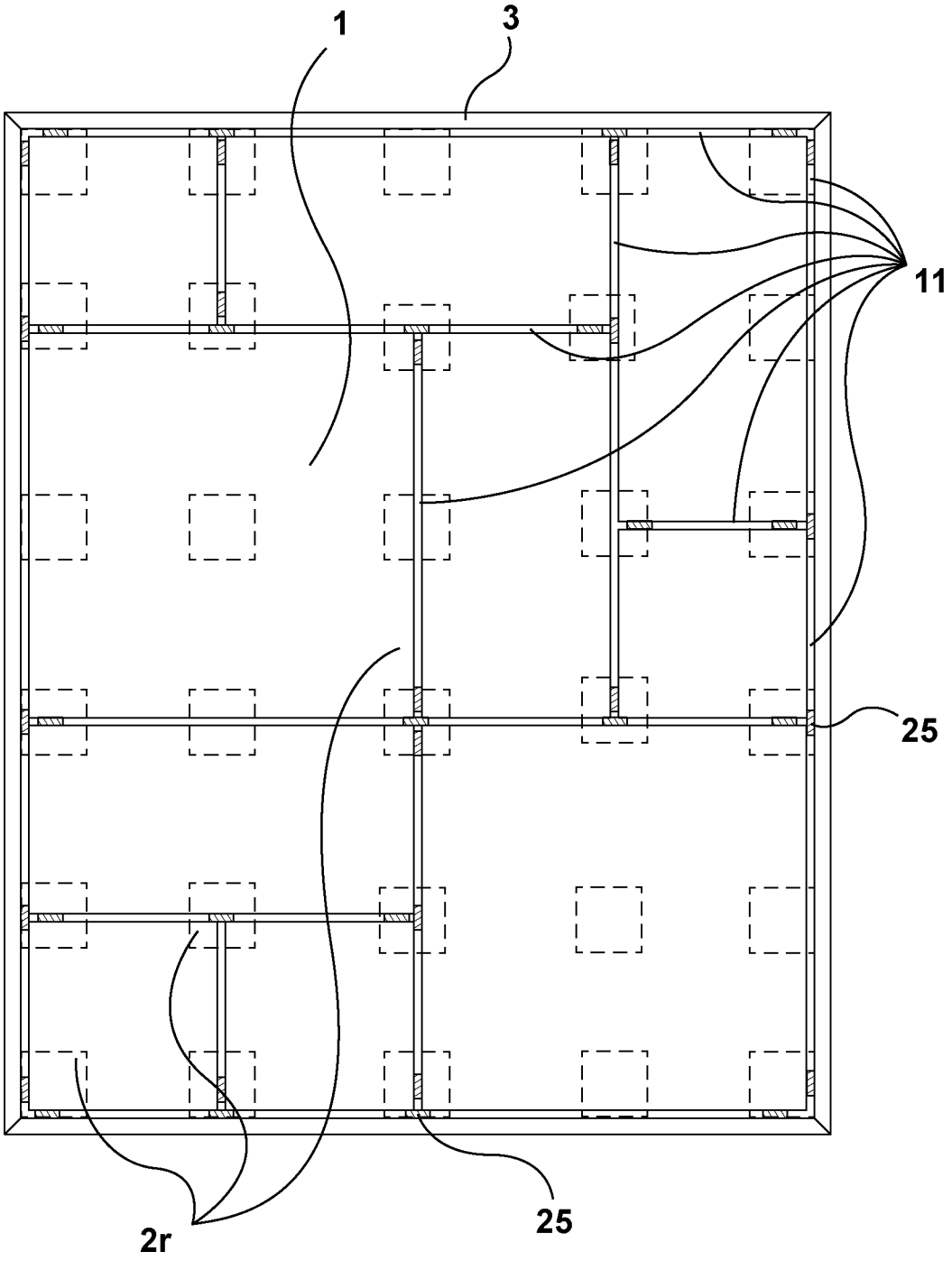
FIG. 13A is a top view of the system described herein, with small flexible support screen pads inserted to support the tiles.
Figure 13B:
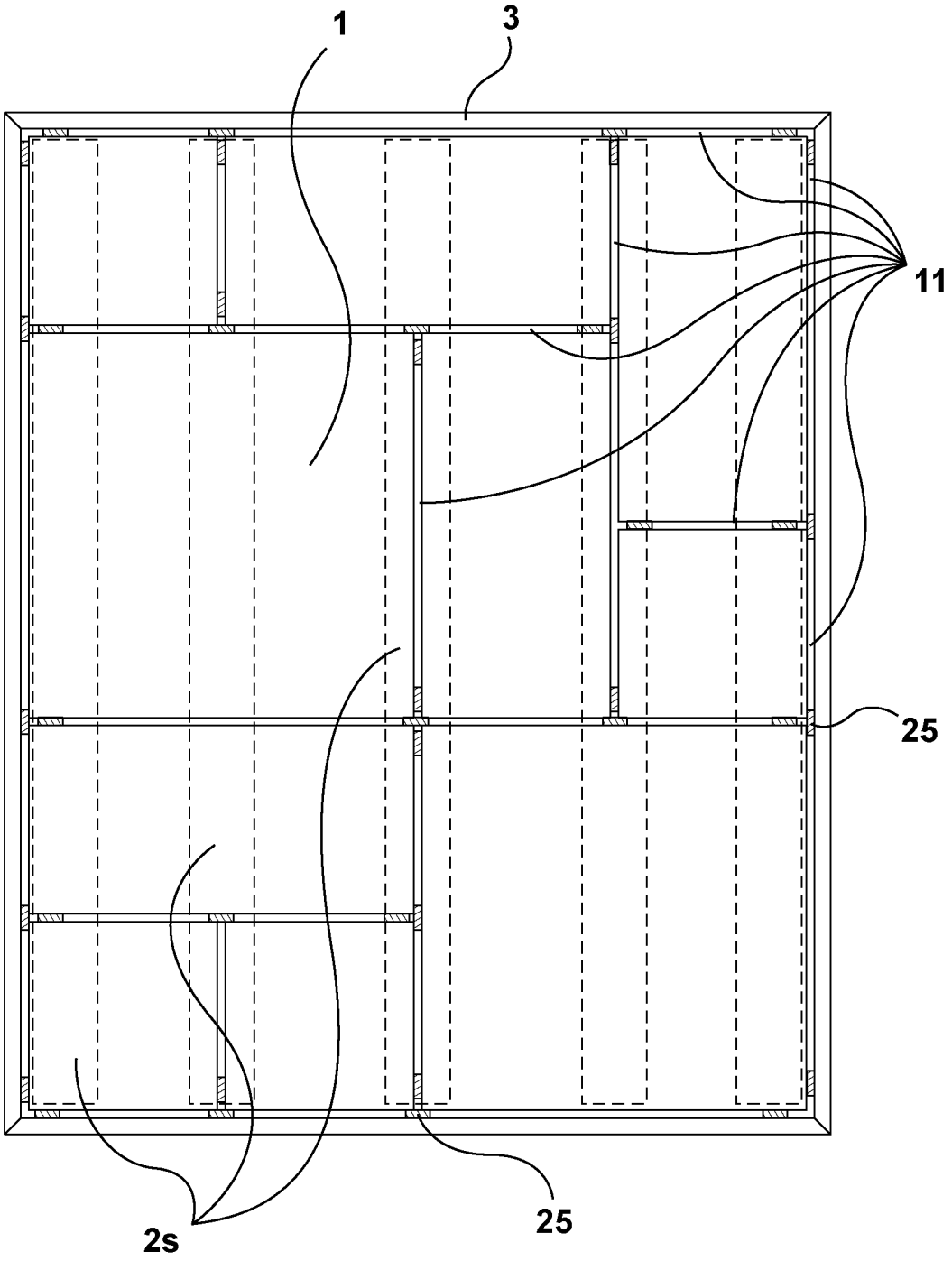
FIG. 13B is a top view of the system described herein, with long flexible support screen planks inserted to support the tiles
Figure 13C:
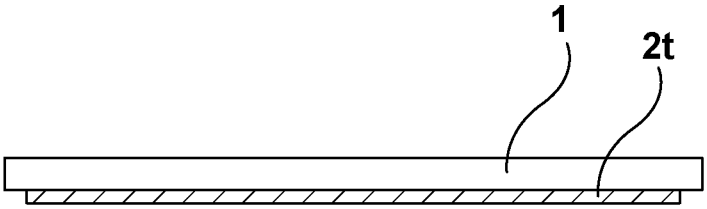
FIGS. 13C and 13D are side and top views, respectively, of a flexible support screen according to one embodiment adhered to an individual floating tile.

When gaps 11 are narrow and the installer determines that polymeric sand or flexible grout will not be utilized in the installation of the system described herein, the installer may utilize discontinuous pieces of support screen 2 as depicted by FIGS. 13A through 13C below. As shown, the flexible support screen 2 is generally arranged to be placed underneath either at an edge, a corner or a center of each of the floating tiles 1. More than one floating tile 1 may be placed on each flexible support screen 2. The use of a plurality of flexible support screens 2 strategically placed underneath portions of the tiles 1 will reduce the amount of flexible support screen material when compared to the use of a continuous flexible support screen that extends across the entire tops surface of the underlying structure. The location of each flexible support screen 2 can be individually selected by the installer to accommodate a desired installation plane for the tiles. In some embodiments, the flexible support screens 2 can be placed at a distance of about 12 inches measured center-to-center from an adjacent flexible support screen 2 to support the tiles 1.

FIG. 13A is a top view of the system described herein with support screen 2 being discontinuous and shown as small pads 2*r*.

FIG. 13B is a top view of the system described herein with support screen 2 being discontinuous and shown as strips 2*s*.

Figure 13D:
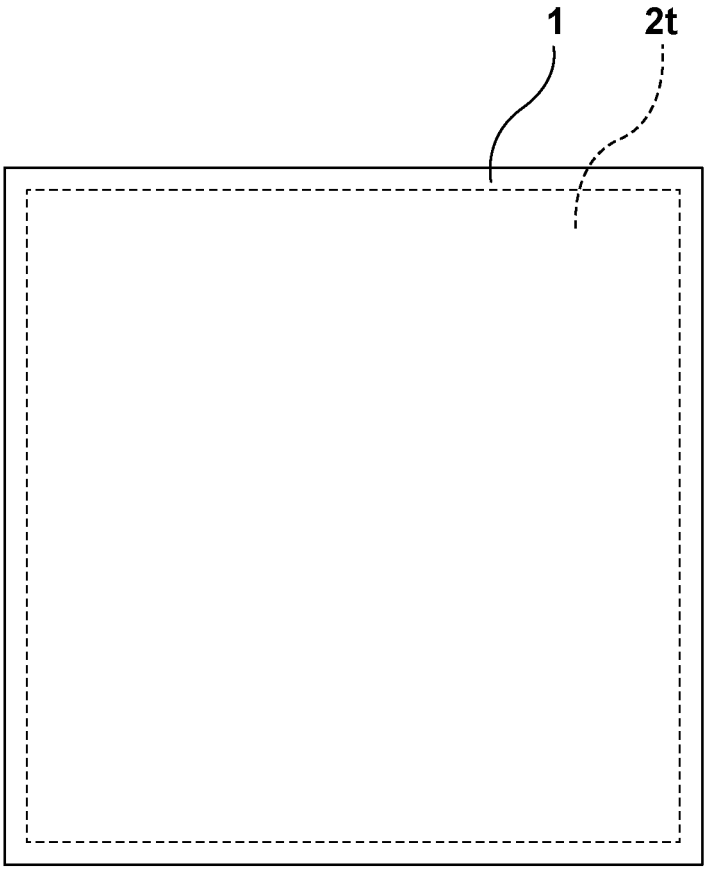

FIGS. 13C and 13D show a side and top views, respectively, of an embodiment flexible support screen 2*t*. Herein, flexible support screen 2*t* is shown as being adhered to an individual floating tile 1. Specifically, flexible support screen 2*t* is adhered to a bottom surface of the tile 2 using an adhesive.

The following represents a sequence of installation for system described herein, according to one embodiment.

a. Inspect structural base for integrity, flatness, squareness, etc. and make required adjustments (i.e. replace boards, grind high points etc.)
b. Install edge retention system as per FIGS. 2A-2D
c. Install support screen 2
d. Install 2 spacers 25 or 26 with adhesive on each edge of the first tile
e. Decide on the location of the first tile.

f. Place the tile carefully onto the support screen making sure it lays flat in its final position against a retention edge (if it does not lay flat, cut out the high point in the support screen 2)

g. Remove the protector tabs on one edge of the tile and slide the tile to its final position.

h. Remove protector tabs from another face of the tile.

i. Install the next tile by adding spacers 25 or 26 as required while repeating steps f, g and h above with subsequent tiles until the field is full.

j. Install the final non-adhesive spacers 25 or 26 in low traffic areas k. Install polymeric sand or flexible gout as desired.

The invention claimed is:

1. A flexible support screen of an outdoor decking system, the flexible support screen being configured to support a plurality of tiles on a top surface of an outdoor decking structure when the flexible support screen is positioned between the top surface of the outdoor decking structure and at least one of the plurality of tiles, each tile being unadhered to the flexible support screen and laterally spaced apart from adjacent tiles to form spaces between each tile and the adjacent tiles, the flexible support screen comprising:

a drainage layer comprising:

a top surface having a plurality of upper openings;

a bottom surface spaced apart from the top surface, the bottom surface having a plurality of lower openings; and a plurality of channels, each channel extending between an upper opening of the top surface and a lower opening of the bottom surface, each of the plurality of channels being configured to receive a fluid at the upper opening of the top surface and direct the fluid through the drainage layer to the lower opening of the bottom surface and on to the top surface of the outdoor decking structure; and a bedding layer positioned on the top surface of the drainage layer, the bedding layer being an elastomeric polymer and more compressible than the drainage layer, the bedding layer comprising:

a top surface configured to engage a bottom surface of at least one of the plurality of tiles; and a bottom surface configured to engage the top surface of the drainage layer;

wherein the bedding layer has a hardness within a range of Shore OO Scale 50 and Shore A Scale 40 and a thickness in a range of 0.030 inches and 0.125 inches to provide for at least one of the plurality of tiles to bed into the bedding layer and for the bedding layer to inhibit lateral movement of the at least one tile; and wherein the flexible support screen has a thickness in a range of 0.188 inches to 0.500 inches.

2. The flexible support screen of claim 1, wherein the drainage layer is configured to inhibit water from travelling laterally through the drainage layer.

3. The flexible support screen of claim 1, wherein one or more of the plurality of lower openings are formed by an edge of a respective channel, the edge being configured to be spaced apart from the top surface of the outdoor decking structure when the flexible support screen is positioned on the top surface of the outdoor decking structure to provide for the fluid to travel laterally across the top surface of the outdoor decking structure, beneath the edge and underneath one or more adjacent lower openings after passing through the drainage layer.

4. The flexible support screen of claim 1, wherein the bedding layer is configured to provide for the fluid to pass between the top surface of the bedding layer and the bottom surface of the bedding layer.

5. The flexible support screen of claim 1, wherein the drainage layer and the bedding layer are flexible and compressible and maintain their structural integrity in normal indoor and outdoor environmental conditions.

6. The flexible support screen of claim 1, wherein the bedding layer is compressible upon receiving a load on its top or bottom surface.

7. The flexible support screen of claim 1, wherein the drainage layer has a variable rate of compression upon receiving a force directed upon either the top surface of the drainage layer or the bottom surface of the drainage layer.

8. The flexible support screen of claim 1, wherein the bedding layer and the drainage layer are integral with each other.

9. The flexible support screen of claim 1, wherein the bedding layer and the drainage layer are attached to each other.

10. The flexible support screen of claim 1, wherein the channels are arranged in a regular pattern across the drainage layer.

11. The flexible support screen of claim 1, wherein the channels are arranged in an irregular pattern across the drainage layer.

12. The flexible support screen of claim 1, wherein the flexible support screen is sufficiently flexible to maintain its shape after being rolled up over itself.

13. The flexible support screen of claim 1, wherein the top surface of the bedding layer has a coefficient of static friction of at least 0.8 for engaging the bottom surface of the tile.

14. The flexible support screen of claim 1, wherein the plurality of lower openings are configured to be spaced apart from the top surface of the outdoor decking structure when the bottom surface of the drainage layer is resting on the top surface of the outdoor decking structure to provide for water passing through the plurality of channels to travel laterally across the top surface of the outdoor decking structure below the lower openings.

15. The flexible support screen of claim 1, wherein the elastomeric polymer comprises a styrene-butadiene copolymer.

* * * * *